US011673755B2

(12) United States Patent
Miyagawa

(10) Patent No.: US 11,673,755 B2
(45) Date of Patent: Jun. 13, 2023

(54) SHEET SUCTION DEVICE, CONVEYOR, PRINTER, AND SUCTION REGION CHANGING DEVICE

(71) Applicant: Ricoh Company, Ltd., Tokyo (JP)

(72) Inventor: Hiroaki Miyagawa, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 1 day.

(21) Appl. No.: 17/148,053

(22) Filed: Jan. 13, 2021

(65) Prior Publication Data

US 2021/0229942 A1 Jul. 29, 2021

(30) Foreign Application Priority Data

Jan. 27, 2020 (JP) ..... JP2020-010698

(51) Int. Cl.
*B65H 5/22* (2006.01)
*B41J 13/22* (2006.01)

(52) U.S. Cl.
CPC ..... *B65H 5/226* (2013.01); *B41J 13/226* (2013.01); *B65H 2511/10* (2013.01); *B65H 2511/12* (2013.01)

(58) Field of Classification Search
CPC .. B65H 5/226; B65H 5/222; B65H 2406/332; B65H 2406/361; B65H 2406/3612; B65H 2406/362; B65H 2406/3622; B65H 2511/10; B65H 2511/11; B65H 2511/12; B65H 29/243; B41J 13/226
See application file for complete search history.

(56) References Cited

U.S. PATENT DOCUMENTS 6,038,976 A * 3/2000 Helmstadter ..... B41F 21/102 101/232
6,296,601 B1 * 10/2001 Couturier ..... B65H 35/08 83/563
7,150,456 B2 * 12/2006 Gerstenberger ..... B41F 21/108 271/276
9,315,331 B2 * 4/2016 Gieser ..... B65H 29/243
2016/0368287 A1 * 12/2016 Dolz ..... B41F 21/102
2020/0039772 A1 2/2020 Miyagawa

FOREIGN PATENT DOCUMENTS

DE 10012743 A1 * 9/2001 ..... A24C 5/1857
JP 6-019378 1/1994
JP 2013-240997 12/2013
JP 2013-241272 12/2013
JP 2020-019637 2/2020

* cited by examiner

*Primary Examiner* — Luis A Gonzalez
(74) *Attorney, Agent, or Firm* — Xsensus LLP

(57) ABSTRACT

A sheet suction device includes a bearing member configured to bear a sheet on a circumferential surface of the bearing member and rotate in a first direction, a plurality of suction holes in a bearing region in the circumferential surface of the bearing member, a suction device connected to the plurality of suction holes, the suction device configured to suck the sheet through the plurality of suction holes, and a first member between the plurality of suction holes and the suction device, the first member rotatable in a second direction different from the first direction to change a suction region of the suction device connected to the plurality of suction holes. A rotation of the first member in the second direction expands the suction region of the suction device in the bearing region of the bearing member.

14 Claims, 18 Drawing Sheets

SHEET SUCTION DEVICE, CONVEYOR, PRINTER, AND SUCTION REGION CHANGING DEVICE

CROSS-REFERENCE TO RELATED APPLICATION

This patent application is based on and claims priority pursuant to 35 U.S.C. § 119(a) to Japanese Patent Application No. 2020-010698, filed on Jan. 27, 2020, in the Japan Patent Office, the entire disclosures of which is hereby incorporated by reference herein.

BACKGROUND

Technical Field

Aspects of the present disclosure relate to a sheet suction device, a conveyor, a printer, and a suction region changing device.

RELATED ART

A printer includes a rotation member such as a drum and performs printing while bearing a sheet on the drum to convey the sheet, for example.

A conveyor suctions and attracts the sheet on the drum to bear the sheet around a circumferential surface of the drum to convey the sheet.

For example, the conveyor includes a drum to suck and convey the sheet. The drum includes a plurality of suction holes formed on an entire circumferential surface of a support surface of the drum. The support surface of the drum supports the sheet.

The drum includes three suction areas that suck an entire surface of the sheet. The drum further includes a plurality of suction parts that divide each suction area into a plurality of suction parts. The conveyor includes a switching part between the plurality of suction parts and a negative pressure source.

The switching part switches connection between each suction parts and the negative pressure source. The conveyor includes a controller to individually control a suction operation of the plurality of suction parts via a switching part based on a size of the sheet.

SUMMARY

In an aspect of this disclosure, a sheet suction device includes a bearing member configured to bear a sheet on a circumferential surface of the bearing member and rotate in a first direction, a plurality of suction holes in a bearing region in the circumferential surface of the bearing member, a suction device connected to the plurality of suction holes, the suction device configured to suck the sheet through the plurality of suction holes, and a first member between the plurality of suction holes and the suction device, the first member rotatable in a second direction different from the first direction to change a suction region of the suction device connected to the plurality of suction holes. A rotation of the first member in the second direction expands the suction region of the suction device in the bearing region of the bearing member.

In another aspect of this disclosure, a suction region changing device between a plurality of suction holes and a suction device, the suction region changing device includes a first member between the plurality of suction holes and the suction device, the first member configured to rotate and change a suction region of the suction device connected to the plurality of suction holes to suck a sheet, and a second member including a plurality of holes on a side surface in a circumferential direction of the second member. The first member includes grooves connected to the suction device, the grooves on a side surface in a circumferential direction of the first member, and a rotation of the first member in one direction relative to the second member increases a number of the plurality of holes of the second member connected to the grooves of the first member and increases a number of the plurality of suction holes connected to the suction device.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
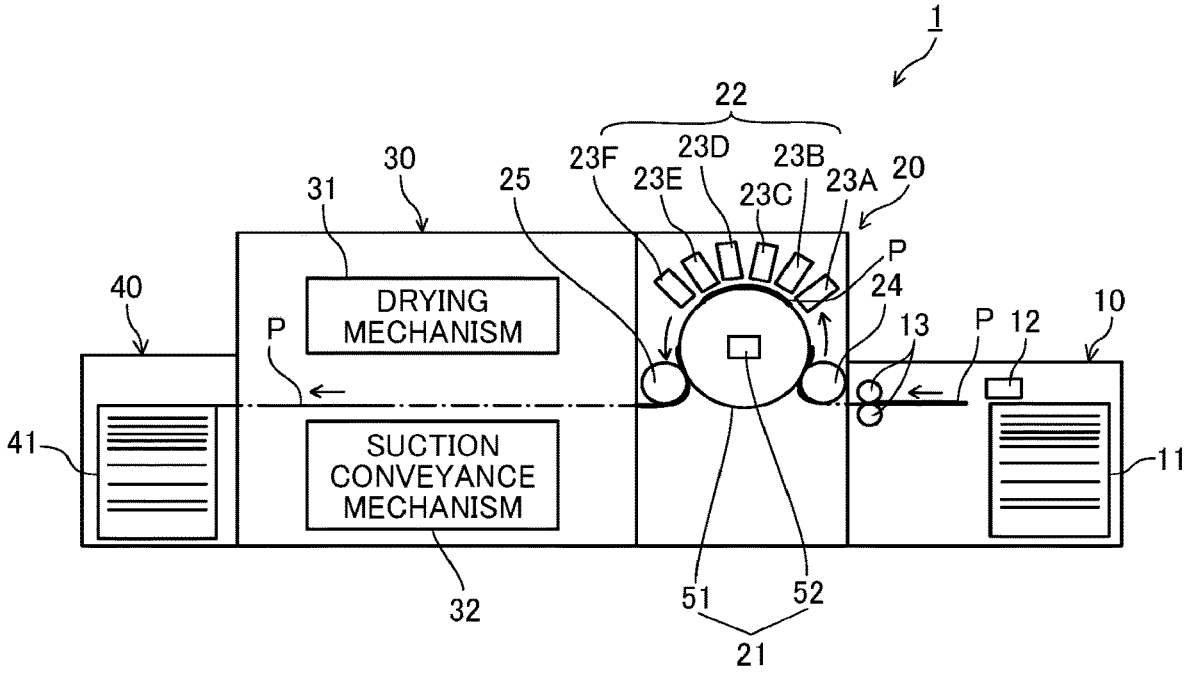
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. Next, a printer 1 according to a first embodiment of the present disclosure is described with reference to FIGS. 1 and 2.

Figure 2:
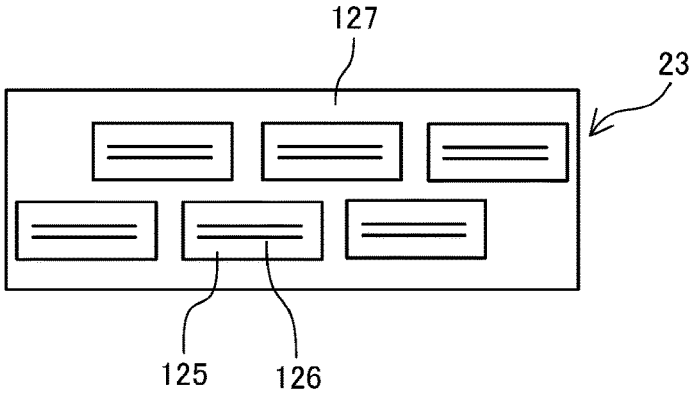
FIG. 2 is a plan view of a discharge unit of the printer.

FIG. 1 is a schematic side view of the printer 1 according to the first embodiment of the present disclosure. FIG. 2 is a plan view of an example of a discharge unit 23 of the printer 1.

The printer 1 includes a loading device 10, a printing device 20, a drying device 30, and an ejection device 40. The printer 1 applies a liquid to a sheet P conveyed from the loading device 10 by the printing device 20 to perform required printing, dries the liquid adhering to the sheet P by the drying device 30, and ejects the sheet P to the ejection device 40.

The loading device 10 includes a loading tray 11 on which a plurality of sheets P are stacked, a feeding device 12 to separate and feed the sheets P one by one from the loading tray 11, and a resist roller pair 13 to feed the sheet P to the printing device 20.

Any feeder such as a device using a roller or a device using air suction may be used as the feeding device 12. The sheet P delivered from the loading tray 11 by the feeding device 12 is delivered to the printing device 20 by the resist roller pair 13 being driven at a predetermined timing after a leading end of the sheet P reaches the resist roller pair 13.

The printing device 20 includes a sheet conveyor 21 to convey the sheet P. The sheet conveyor 21 includes a drum 51 and a suction device 52. The drum 51 is a bearing member (rotating member) that bears the sheet P on a circumferential surface of the drum 51 and rotates in a rotation direction (first direction). The suction device 52 generates a suction force on the circumferential surface of the drum 51. The printing device 20 includes a liquid discharge device 22 that discharges the liquid toward the sheet P borne on the drum 51 of the sheet conveyor 21 to apply the liquid onto the sheet P.

The printing device 20 further includes a transfer cylinder 24 and a delivery cylinder 25. The transfer cylinder 24 receives the sheet P fed from the resist roller pair 13 and transfers the sheet P to the drum 51. The delivery cylinder 25 delivers the sheet P conveyed by the drum 51 to the drying device 30.

A leading end of the sheet P conveyed from the loading device 10 to the printing device 20 is gripped by a sheet gripper provided on a surface of the transfer cylinder 24 and is conveyed in accordance with the rotation of the transfer cylinder 24. The transfer cylinder 24 forwards the sheet P to the drum 51 at a position opposite (facing) the drum 51.

Similarly, the drum 51 includes a sheet gripper on a surface of the drum 51, and the leading end of the sheet P is gripped by the sheet gripper of the drum 51. A plurality of suction holes is dispersedly formed on the surface of the drum 51. The suction device 52 generates a suction airflow from a desired plurality of suction holes of the drum 51 toward an interior of the drum 51. The suction device 52 serves as a suction device.

The sheet gripper 106 (see FIG. 4) of the drum 51 grips the leading end of the sheet P forwarded from the transfer cylinder 24 to the drum 51, and the sheet P is attracted to and borne on the drum 51 by the suction airflows by the suction device 52. As the drum 51 rotates, the sheet P is conveyed in the rotation direction (first direction).

The liquid discharge device 22 includes discharge units 23 (23A to 23F) to discharge liquids of each color, for example, yellow (Y), cyan (C), magenta (M), and black (K). For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively. Further, the discharge units 23E and 23F are used to discharge any one of YMCK or special liquid such as white and gold (silver). Further, the liquid discharge device 22 may further include a discharge unit to discharge a processing liquid such as a surface coating liquid.

Each of the discharge unit 23 is full line heads and includes a plurality of liquid discharge heads 125 arranged in a staggered manner on a base 127. Each of the liquid discharge head 125 includes a plurality of nozzle arrays 126 and a plurality of nozzles arranged in each of the nozzle arrays 126, for example as illustrated in FIG. 2. Hereinafter, the "liquid discharge heads 125" is simply referred to as "heads 125."

A discharge operation of each of the discharge units 23 of the liquid discharge device 22 is controlled by drive signals corresponding to print information. When the sheet P borne on the drum 51 passes through a region facing the liquid discharge device 22, the liquid of each color is discharged from the discharge units 23, and an image corresponding to the print information is printed on the sheet P.

The drying device 30 includes a drying mechanism 31 and a suction conveyance mechanism 32. The drying mechanism 31 dries the liquid adhered on the sheet P by the printing device 20. The suction conveyance mechanism 32 conveys (suctions and conveys) the sheet P while suctioning the sheet P conveyed from the printing device 20 onto the suction conveyance mechanism 32.

After the sheet P conveyed from the printing device 20 is received by the suction conveyance mechanism 32, the sheet P is conveyed to pass through the drying mechanism 31 and delivered to the ejection device 40.

When the sheet P passes through the dying mechanism 31, the liquid on the sheet P is subjected to a drying process by drying mechanism 31. Thus, the liquid component such as water in the liquid evaporates. The colorant contained in the liquid is fixed on the sheet P. Thus, curling of the sheet P is reduced.

The ejection device 40 includes an ejection tray 41 on which a plurality of sheets P are stacked. The sheets P conveyed from the drying device 30 are sequentially stacked and held on the ejection tray 41.

For example, the printer 1 may include a pre-processing unit to perform pre-processing of image formation on the sheet P. The pre-processing unit is disposed on an upstream of the printing device 20. Further, the printer 1 may include a post-processing unit that performs post-processing on the sheet P, to which the liquid is adhered. The post-processing unit is disposed between the drying device 30 and the ejection device 40.

For example, the pre-processing unit may perform a pre-application process that applies a treatment liquid onto the sheet P before image is printed on the sheet P. The treatment liquid reacts with the liquid to reduce bleeding of the liquid to the sheet P.

However, the content of the pre-application process is not particularly limited to the process as described above. Further, the post-processing unit may perform a sheet reversing process and a binding process to bind a plurality of sheets P, for example. The sheet reversing process reverses the sheet P, on which image is printed by the printing device 20, and conveys the reversed sheet P again to the printing device 20 to print on both sides of the sheet P.

The printing device 20 according to the first embodiment includes the discharge unit 23 to discharge a liquid. The printing device 20 according to the first embodiment may perform printing by a method other than the liquid discharge operation such as an electrographic method.

The sheet suction device 50 according to a first embodiment of the present disclosure is described with reference to FIG. 3.

Figure 3:
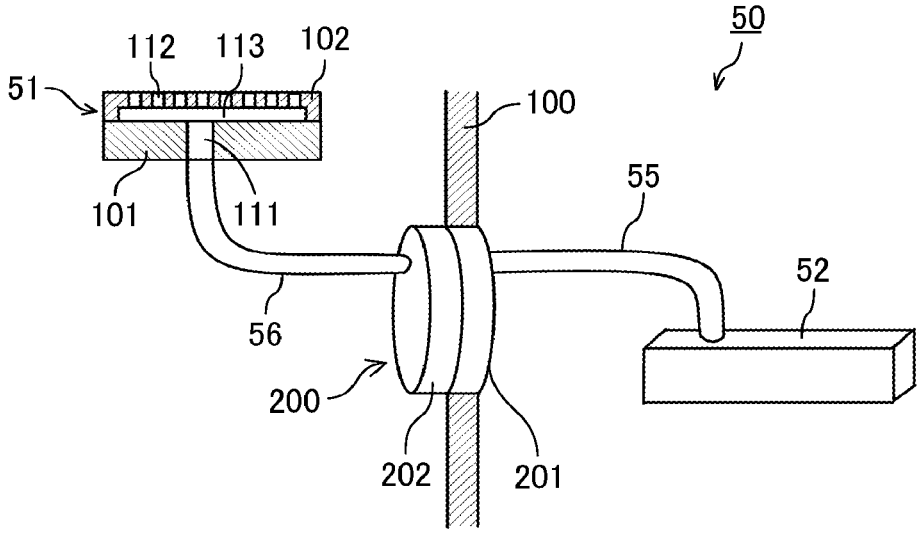
FIG. 3 is a schematic side view of an entire configuration of a sheet suction device according to the first embodiment of the present disclosure.

FIG. 3 is a schematic of side view of an overall structure of a sheet suction device 50 of the printer 1.

The sheet suction device 50 includes a drum 51, a suction device 52 as a suction means, and a rotary valve 200 as a suction area switching device arranged between the drum 51 and the suction device 52. The suction device 52 communicated with the rotary valve 200 via a hose 55 (tube). The rotary valve 200 communicated with the drum 51 via a hose 56 (tube).

Next, the drum 51 according to the first embodiment is described with reference to FIGS. 4 to 7.

Figure 4:
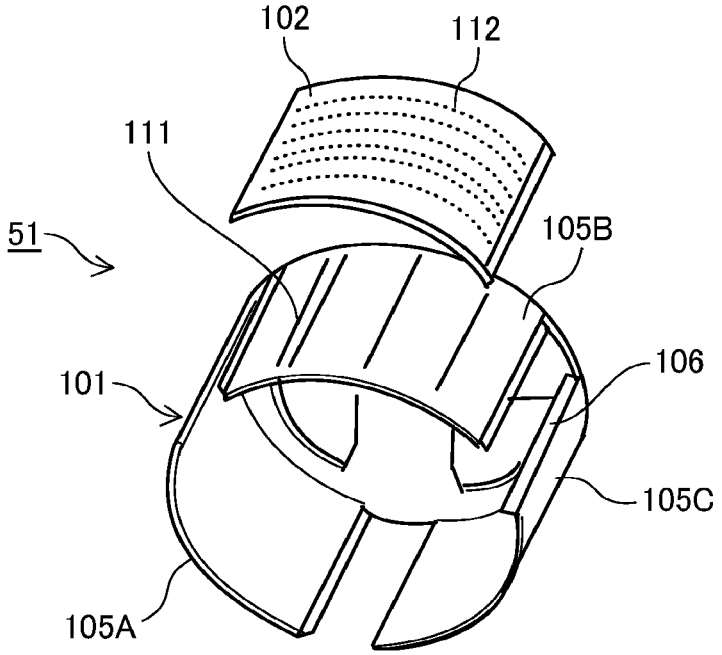
FIG. 4 is an exploded perspective view of a drum of the sheet suction device.

FIG. 4 is an exploded perspective view of the drum 51.

Figure 5:
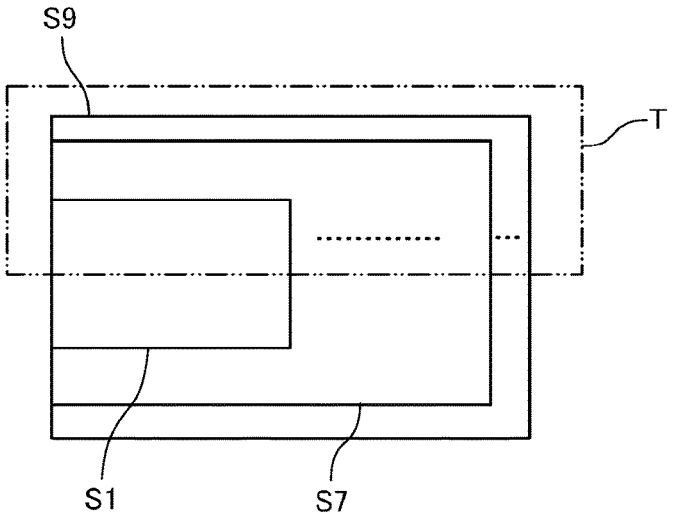
FIG. 5 is a plan view of the drum illustrating a sheet size in one bearing region of the drum.

FIG. 5 is a plan view of the drum 51 illustrating a sheet size in one bearing region 105 of the drum 51.

Figure 6:
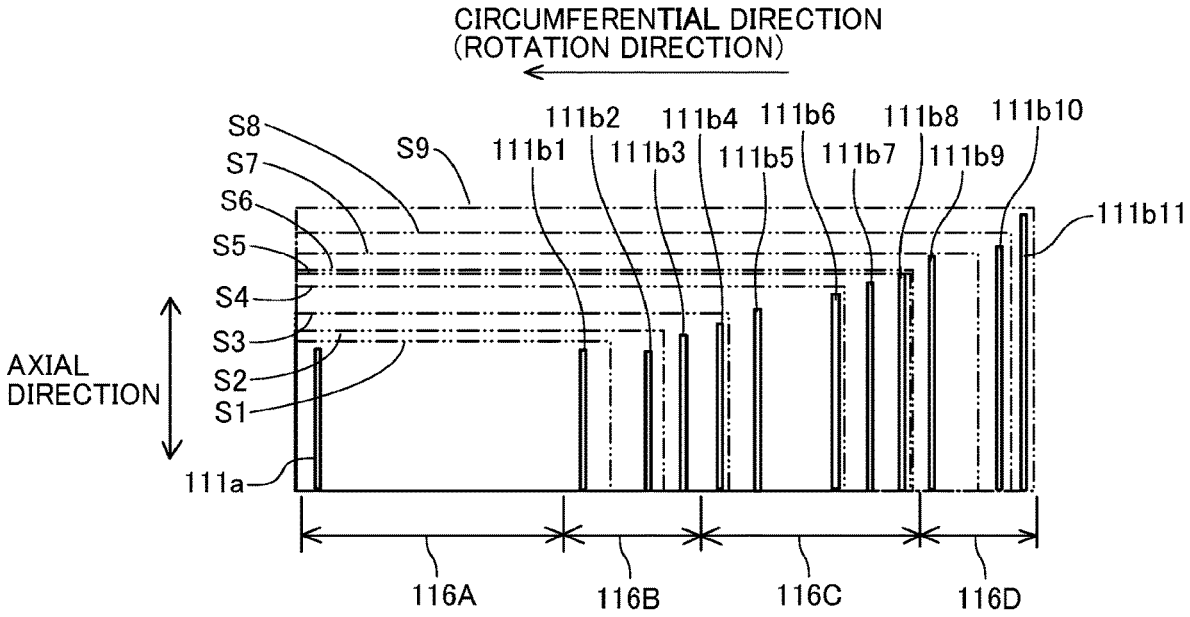
FIG. 6 is an enlarged schematic plan view of a T-portion of FIG. 5 illustrating an arrangement of suction ports in a circumferential direction of the drum 51 and the sheet size.

FIG. 6 is an enlarged schematic plan view of a T-portion of FIG. 5 illustrating an arrangement of suction ports in a circumferential direction of the drum 51 and the sheet size.

Figure 7:
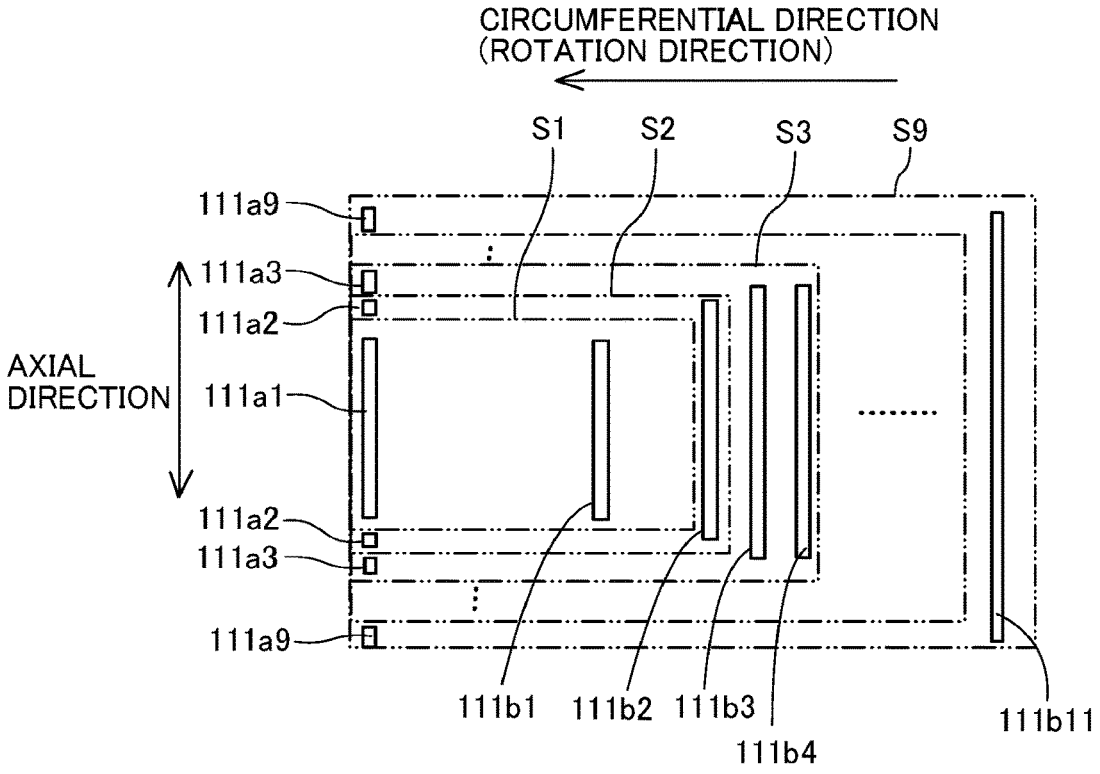
FIG. 7 is an enlarged schematic view of the drum illustrating an arrangement of the suction ports in an axial direction and the circumferential direction of the drum, and the sheet size.

FIG. 7 is an enlarged schematic view of the drum 51 illustrating the arrangement of the suction ports in an axial direction and the circumferential direction of the drum 51, and the sheet size.

Figure 8:
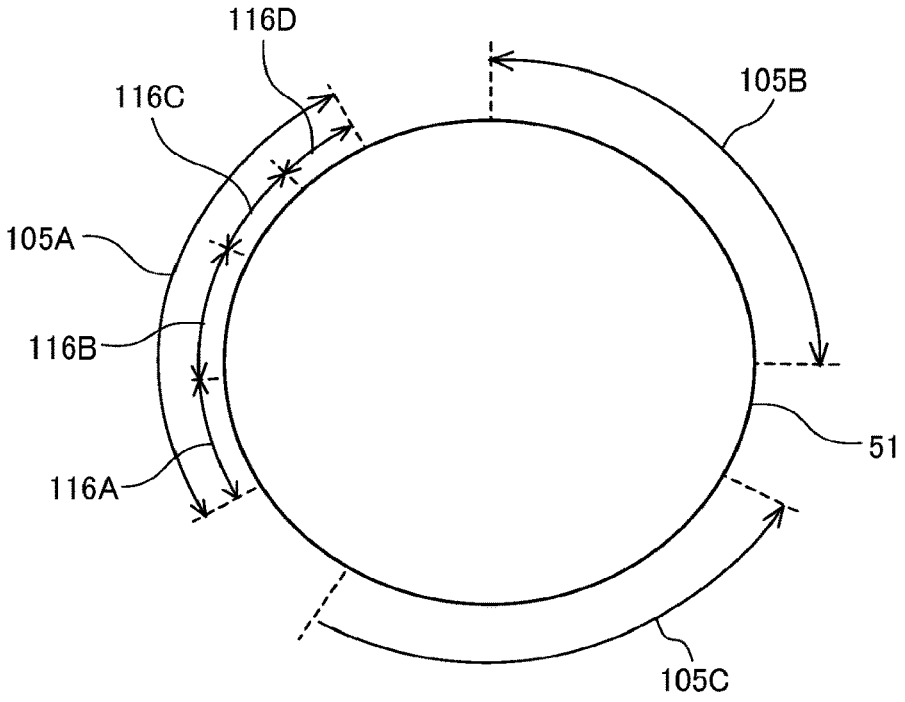
FIG. 8 is a schematic side-view of the drum illustrating the bearing region and divided regions of the bearing region.

FIG. 8 is a schematic side-view of the drum 51 illustrating the bearing region 105 and divided regions of the bearing region 105.

The drum 51 includes a drum body 101 and a suction plate 102. A sealing material such as a rubber sheet may be interposed between the suction plate 102 and the drum body 101.

The drum 51 includes three bearing regions 105 (105A to 105C) and is bearable a plurality of sheets P in the circumferential direction of the drum 51. As illustrated in FIGS. 3 and 4, the drum 51 includes the suction plate 102 and the drum body 101 in each of the bearing regions 105. The suction plate 102 includes a plurality of suction holes 112 and forms a chamber 113 communicating with each of the suction holes 112. The drum body 101 includes a groove shaped suction port 111 communicating with the chamber 113. The drum 51 includes a sheet gripper 106 at a leading end of the bearing region 105 in a rotation direction of the drum 51. The sheet gripper 106 is illustrated in a simplified manner in FIG. 4. The rotation direction is also referred to as a "first direction."

As illustrated in FIGS. 5 and 6, one bearing region 105 includes a plurality of sheet regions S1 to S9 corresponding to a plurality of (here, nine) sheet sizes. Thus, nine sheet regions S1 to S9 are allocated to one bearing region 105. Further, one bearing region 105 includes twelve suction ports 111*a*, 111*b*1 to 111*b*11 arranged in the circumferential direction (rotation direction) of the drum 51. As illustrated in FIG. 7, the suction port 111 includes suction ports 111*a*1 to 111*a*9 arranged in the axial direction (vertical direction in FIG. 7) at the leading end in the rotation direction (left end in FIG. 7). The suction ports 111*a*1 to 111*a*9 respectively correspond to the sheet sizes (sheet region S1 to S9).

For example, the drum 51 includes the suction ports 111*a*1 and 111*b*1 corresponding to the sheet region S1 (see FIGS. 6 and 7). The suction ports 111*a*1 and 111*b*1 communicate with the chamber 113 to which the plurality of suction holes 112 faces. The drum 51 includes the suction ports 111*a*2 and 111*b*2 communicating with the chamber 113 to which a plurality of suction holes 112 in the sheet region S2 excluding the sheet region S1 faces. The drum 51 includes the suction ports 111*a*3, 111*b*3, and 111*b*4 communicating with the chamber 113 to which a plurality of suction holes 112 in the sheet region S3 excluding the sheet regions S1 and S2 faces. The same applies to other sheet regions S4 to S9.

As illustrated in FIG. 8, one bearing region 105 is divided into a first region 116A, a second region 116B, a third region 116C, and a fourth region 116D in the circumferential direction (rotation direction) from the leading end side in the circumferential direction (rotation direction). Here, the drum 51 rotates counterclockwise as indicated by arrows in FIG. 1.

As illustrated in FIG. 6, the first region 116A is allocated to the suction port 111*a* at the leading end in the circumferential direction (rotation direction) of the drum 51. The second region 116B is allocated to the suction ports 111*b*1 to 111*b*3. The third region 116C is allocated to the suction ports 111*b*4 to 111*b*8. The fourth region 116D is allocated to the suction ports 111*b*9 to 111*b*11.

Thus, the sheet suction device 50 can connect the hose 56 (tube) to each suction port 111 (111*a* and 111*b*) on the drum 51 and switch a generation of the negative pressure to each suction port 111 (111*a* and 111*b*) to switch the suction regions S1 and S2.

As illustrated in FIG. 3, the rotary valve 200 includes a rotation part 202 that rotates with the drum 51 and a fixing part 201 connected to the suction device 52 and does not rotate with the drum 51.

Thus, the rotary valve 200 can switch a connection between the suction hole 112 and the suction device 52 according to a relative phase difference between the rotation part 202 and the fixing part 201 to control the timing of generation of the negative pressure on the circumferential surface of the drum 51 (see FIG. 3). The rotary valve 200 connects or disconnects the suction hole 112 and the suction device 52 to switch the connection between the suction hole 112 and the suction device 52. Generally, a metal plate processed into a disk shape is used for both the rotation part 202 and the fixing part 201.

FIGS. 9 to 15 illustrates the rotary valve 200 according to a first embodiment of the present disclosure.

Figure 9:
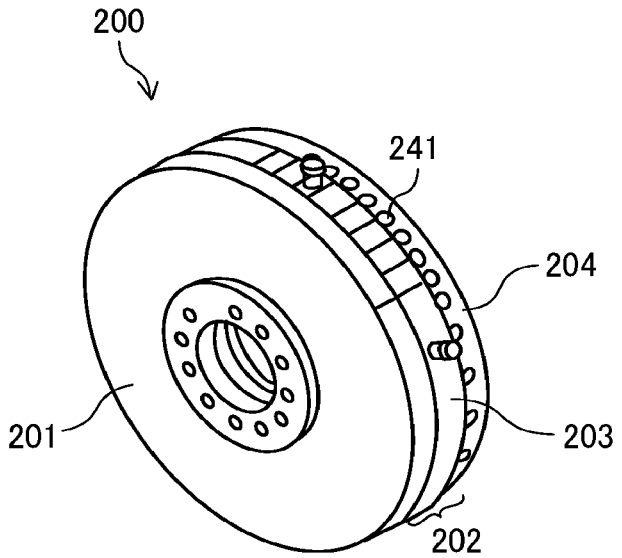
FIG. 9 is an external perspective view of a rotary valve according to a first embodiment of the present disclosure.

FIG. 9 is a schematic external perspective view of the rotary valve 200.

Figure 10:
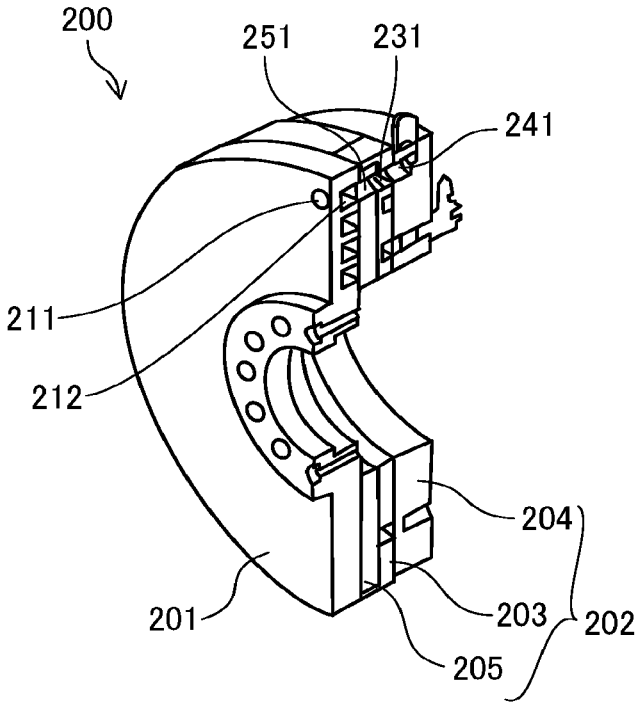
FIG. 10 is a schematic cross-sectional perspective view of the rotary valve cut in half.

FIG. 10 is a schematic cross-sectional perspective view of the rotary valve 200 cut in half.

Figure 11:
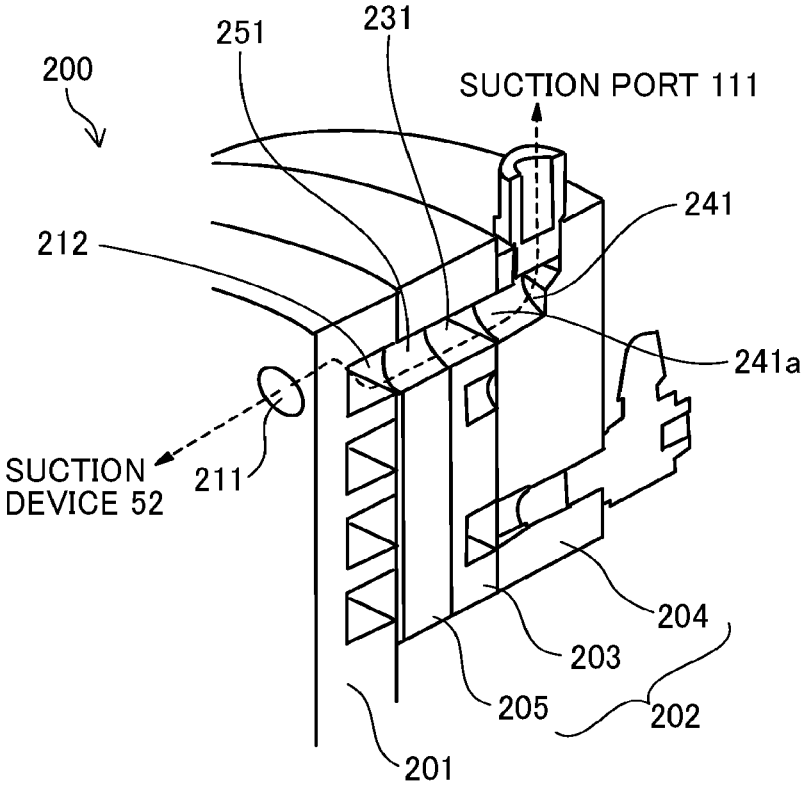
FIG. 11 is a schematic enlarged cross-sectional perspective view of a main part of the rotary valve cut in half.

FIG. 11 is a schematic enlarged cross-sectional perspective view of a main part of the rotary valve 200 cut in half.

Figure 12A:
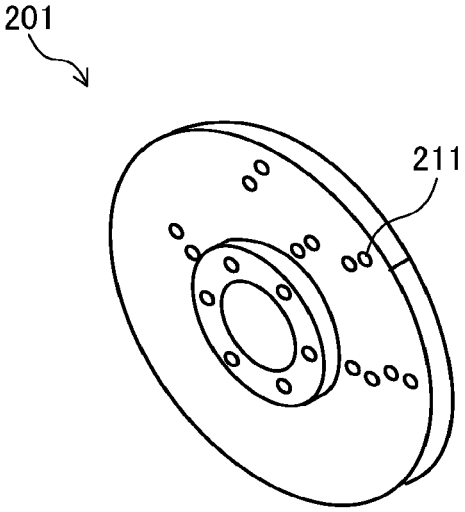
FIGS. 12A and 12B are schematic perspective views of the fixing part that configures the rotary valve.
Figure 12B:
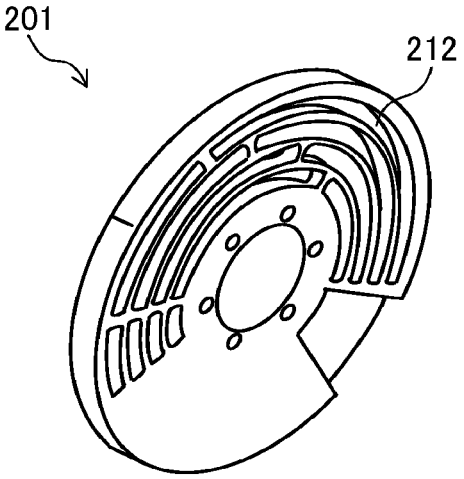

FIGS. 12A and 12B are schematic perspective views of the fixing part 201 that configures the rotary valve 200.

Figure 13:
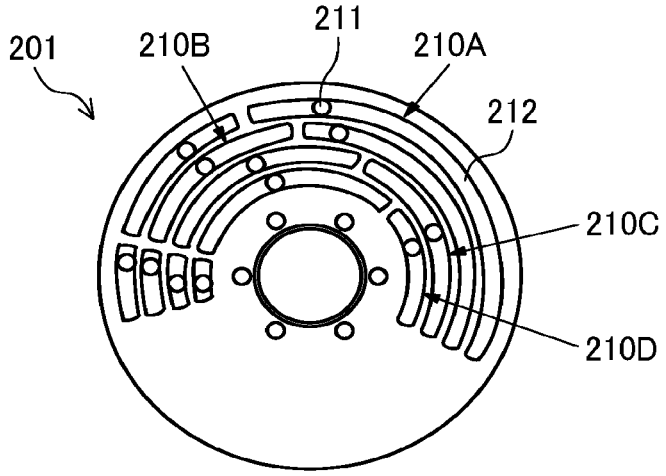
FIG. 13 is a schematic side view of the fixing part.

FIG. 13 is a schematic side view of the fixing part 201.

Figure 14A:
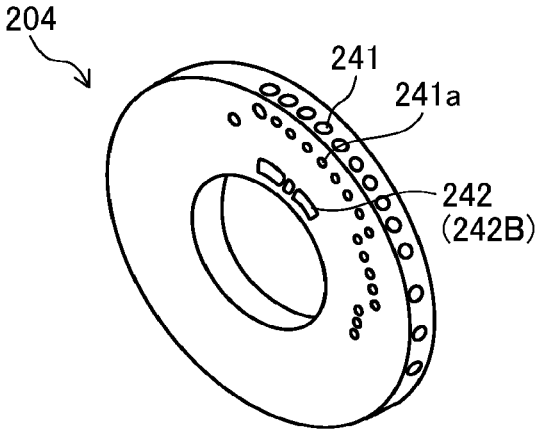
FIGS. 14A and 14B are schematic perspective views of a second member that configures the rotary valve.
Figure 14B:
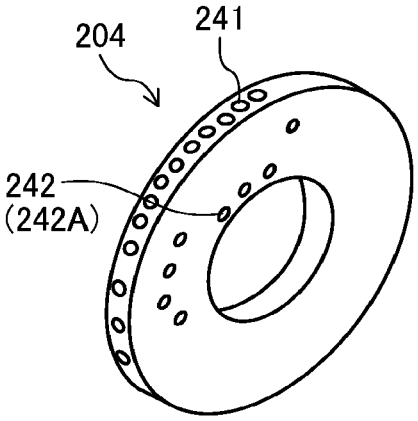

FIGS. 14A and 14B are schematic perspective views of a second member 204 that configures the rotary valve 200.

Figure 15:
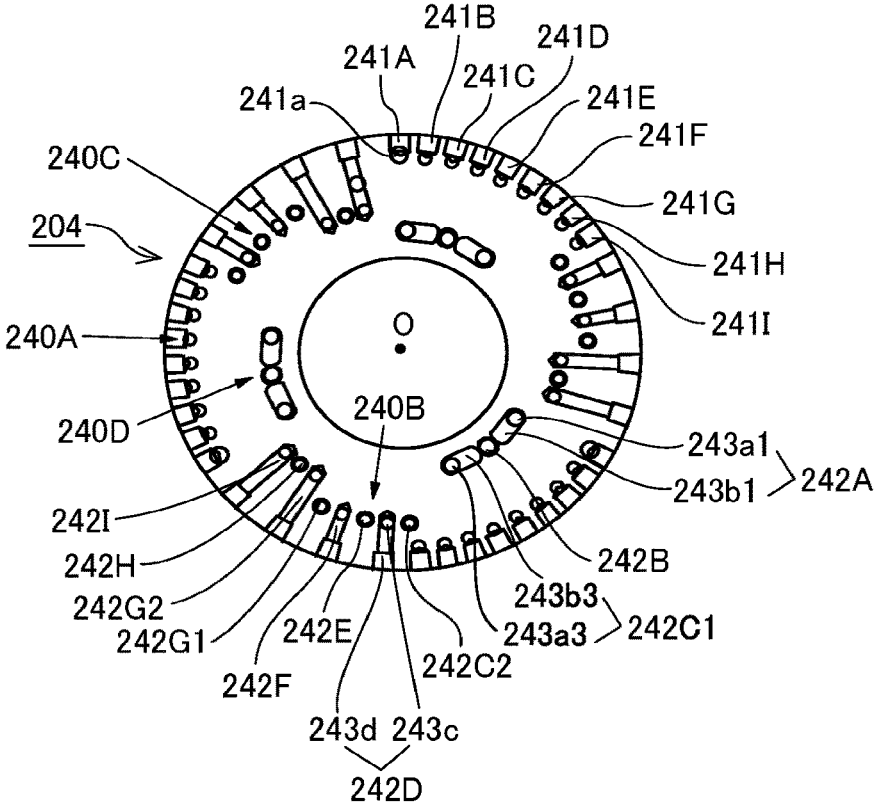
FIG. 15 is a schematic side view of the second member.

FIG. 15 is a schematic side view of the second member 204.

Figure 16A:
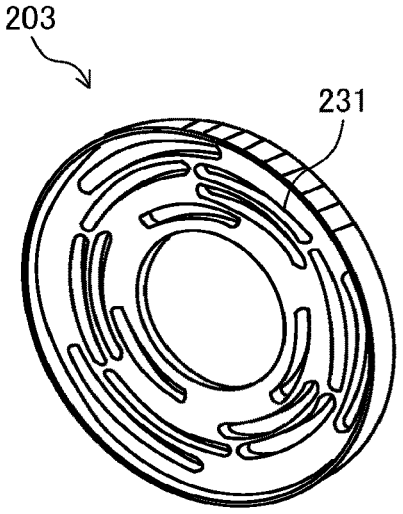
FIGS. 16A and 16B are schematic perspective views of a first member that configures the rotary valve.
Figure 16B:
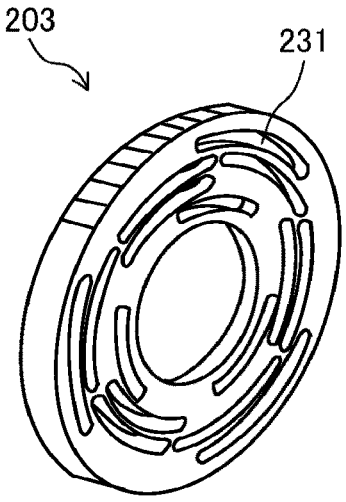

FIGS. 16A and 16B are schematic perspective views of a first member 203 that configures the rotary valve 200.

Figure 17:
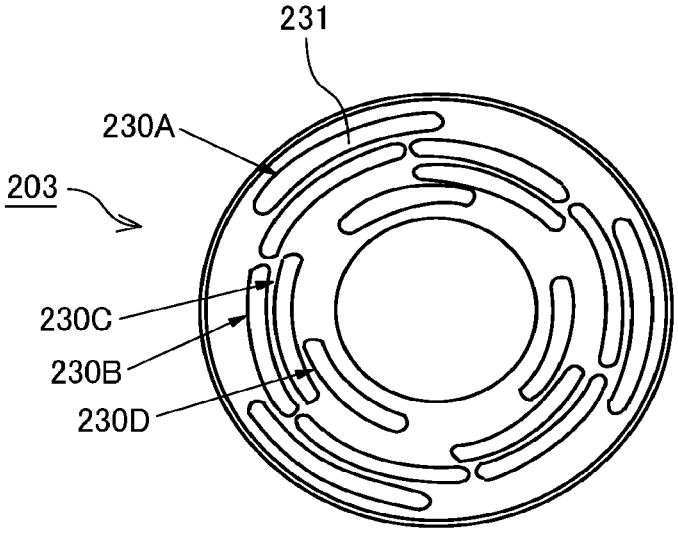
FIG. 17 is a schematic side view of the first member.

FIG. 17 is a schematic side view of the first member 203.

Figure 18A:
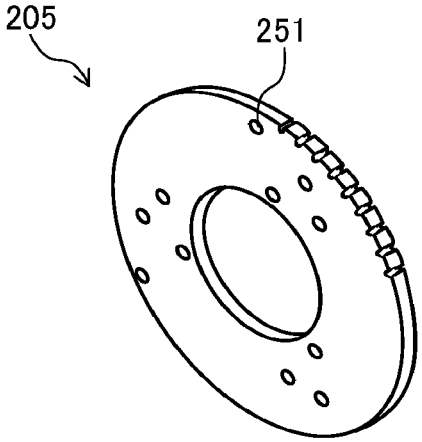
FIGS. 18A and 18B are schematic perspective views of a third member that configures the rotary valve.
Figure 18B:
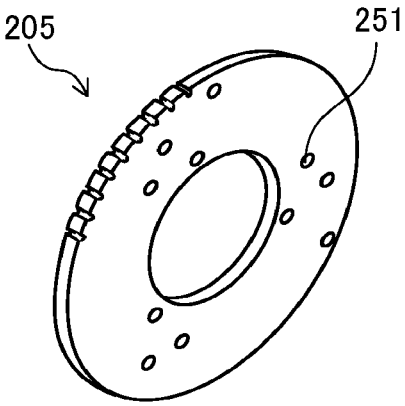

FIGS. 18A and 18B are schematic perspective views of a third member 205 that configures the rotary valve 200.

Figure 19:
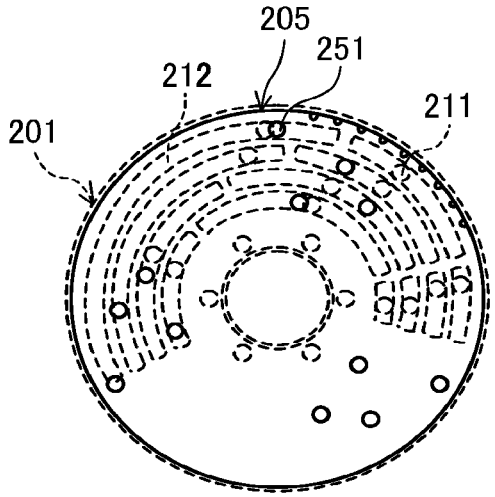
FIG. 19 is a schematic side view of the third member overlaid on the fixing part.

FIG. 19 is a schematic side view of the third member 205 overlaid on the fixing part 201.

As illustrated in FIG. 3, the rotary valve 200 includes a fixing part 201 fixed to a frame 100 of the printer 1. The frame 100 supports the drum 51, the transfer cylinder 24, the discharge unit 23, and the like.

The fixing part 201 includes rows of a plurality of grooves 212 arranged in a radial direction and divided into three parts in the circumferential direction of the fixing part 201. The rows of the plurality of grooves 212 are formed on a side surface of the fixing part 201 to be slidably fitted to the rotation part 202.

Each groove 212 includes a through hole 211 to be connected to the suction device 52. Here, the rows of the grooves 212 positioned on the identical concentric circle are referred to as groove rows 210A, 210B, 210C, and 210D as illustrated in FIG. 13.

The rotation part 202 of the rotary valve 200 includes a first member 203, a second member 204, and a third member 205. The first member 203, the second member 204, and the third member 205 are arranged in an order of the third member 205, the first member 203, and the second member 204 from the fixing part 201 as illustrated in FIG. 10. The first member 203 has a shape covering the outer peripheral surface of the third member 205 in a radial direction of the rotary valve 200. The third member 205 is fitted into the first member 203.

As illustrated in FIGS. 14A and 14B, and FIG. 15, the second member 204 is a disk-shaped member including a plurality of (here, nine) holes 241 (241A to 241I) communicating with the suction port 111 of the drum 51 on a circumferential surface of the second member 204 (disk-shaped member).

Each holes 241 includes an opening 241*a* on a side surface of the second member 204. The side surface of the second member 204 contacts with the first member 203. The nine holes 241A to 241I arranged in the circumferential direction of the second member 204 (see FIG. 15) communicate with the nine suction ports 111*a* (111*a*1 to 111*a*9) in the axial direction of the drum 51 (see FIG. 7). The nine holes 241A to 241I is connectable to the plurality of suction holes 112.

Further, the second member 204 includes a plurality of types of holes 242 (242A to 242I) on the side surface of the second member 204 (disk-shaped member) or the like (see FIG. 15).

The hole 242A includes a through hole 243*a*1 that penetrates the second member 204 in the axial direction and a groove 243*b*1 extending in the circumferential direction (rotation direction) of the second member 204 and communicating with the through hole 243*a*1. Similarly, the hole 242C1 includes a through hole 243*a*3 that penetrates the second member 204 in the axial direction and a groove 243*b*3 extending in the circumferential direction (rotation direction) of the second member 204 and communicating with the through hole 243*a*3.

Each of the holes 242B, 242C2, 242E, 242G1, and 242H includes a through hole 243*a*1 that penetrates the second member 204 in the axial direction. Each of the holes 242D, 242F, 242G2, and 242I includes a non-through hole 243*c* that does not penetrate the second member 204 in the axial direction and a hole 243*d* that extends in the radial direction from the non-through hole 243*c*. The holes 242 as described above also communicates with the suction ports 111.

As illustrated in FIG. 15, the pluralities of holes 241 are provided for each of the bearing regions 105A, 105B, and 105C (see FIGS. 4 and 8). However, the holes 241 for one bearing region 105, for example, are simply illustrated in FIG. 14.

The first member 203 is a disk-shaped member that includes through grooves 231 along a circumferential direction on a side surface of the first member 203 (disk-shaped member). The through grooves 231 are provided for each of the bearing regions 105 (105A, 105B, and 105C, see FIGS. 4 and 8).

As illustrated in FIG. 17, the first member 203 includes the through grooves 231 (230A, 230B, 230C, and 230D) in four positions that are concentric in the radial direction from the outer circumferential side toward the center of the first member 203. Each row of the through grooves 231 positioned on the same concentric circle is collectively referred to as the groove rows 230A, 230B, 230C, and 230D, respectively.

With reference again to FIG. 15, rows of the holes 241 and the holes 242 of the second member 204 corresponding to the groove rows 230A to 230D of the first member 203 are respectively referred to as hole rows 240 (240A to 240D) from the outer circumference side toward the center of the second member 204. Each of the rows of the holes 241 and the holes 242 is arranged in the circumferential direction of the second member 204.

The second member 204 includes the holes 242C1 and 242C2. The holes 242C1 and 242C2 are two or more holes 242 that are simultaneously communicate with the through groove 231 of the groove row 230D and the through groove 231 of the groove row 230B of the first member 203, respectively, by a rotation of the first member 203 for a unit rotation amount. The hole 242C1 belongs to the hole row 240D, and the hole 242C2 belongs to the hole row 240B.

Thus, the holes 242C1 and 242C2 are the two or more holes 242 that simultaneously communicate with the groove row 230D and the groove row 230B, respectively. The holes 242C1 and 242C2 are disposed at different distances from a rotation center "O" of the second member 204 (see FIG. 15). In other words, the two holes 242C1 and 242C2 simultaneously communicate with the groove row 230D and the groove row 230B, respectively. The two holes 242C1 and 242C2 respectively belong to the different hole rows 240D and 240B among the plurality of hole rows 240 arranged in the radial direction of the second member 204.

Similarly, the second member 204 includes the hole 242G1 and 242G2. The holes 242G1 and 242G2 are two or more holes that simultaneously communicate with the through groove 231 of the groove row 230B and the through groove 231 of the groove row 230C of the first member 203, respectively, by the rotation of first member 203 for the unit rotation amount. The hole 242G1 belongs to the hole row 240B, and the hole 242G2 belongs to the hole row 240C of the second member 204.

That is, the holes 242G1 and 242G2 are the two or more holes 242 that simultaneously communicate with the groove row 230B and the groove row 230C of the first member 203, respectively. The holes 242G1 and 242G2 are disposed at different distances from the rotation center O of the second member 204.

In other words, the two holes 242G1 and 242G2 simultaneously communicate with the groove row 230B and the groove row 230C of the first member 203, respectively. The two holes 242G1 and 242G2 respectively belong to the different hole rows 240B and 240C among the plurality of hole rows 240 arranged in the radial direction of the second member 204.

The second member 204 thus configured includes two holes 242C1 and 242C2 or 242G1 and 242G2 simultaneously communicating with corresponding groove rows 230A, 230B, 230C, and 230D of the first member 203 by the rotation of the first member 203 for the unit rotation amount.

Thus, the rotary valve 200 can selects one of the two holes 242C1 and 242C2 or selects one of the two holes 242G1 and 242G2 according to a size of the sheet P to be used. The rotary valve 200 closes one of unselected two holes 242C1 and 242C2 or closes one of unselected two holes 242G1 and 242G2 by a plug. Thus, the rotary valve 200 can easily change the suction region according to a type of a size of the sheet P (destination of the sheet P).

As illustrated in FIGS. 10, 18A and 18B, and 19, the third member 205 is a disk-shaped member that includes a through hole 251 through which the grooves 212 of the fixing part 201 and the through grooves 231 of the first member 203 (see FIGS. 16A and 16B) communicate with each other (see FIG. 10).

The first member 203, the second member 204, and the third member 205 configure the rotation part 202. The first member 203, the second member 204, and the third member 205 rotate along with a rotation of the drum 51 when the sheet P is conveyed in the rotation direction (first direction).

When the rotary valve 200 changes (switches) the suction region (suction area), the rotary valve 200 rotates the first member 203 relative to the second member 204 and the third member 205. The second member 204 rotates together with the third member 205.

Rotation of the first member 203 changes a number of holes 242 of the second member 204 communicating with the through grooves 231 of the first member 203. Thus, a connection status of a suction channel in the rotary valve 200 changes. Thus, the rotary valve 200 can change (switch) the suction region according to the size of the sheet P (destination of the sheet P).

Next, an allocation of the bearing regions 105 and the through grooves 231 is described with reference to FIG. 20.

Figure 20:
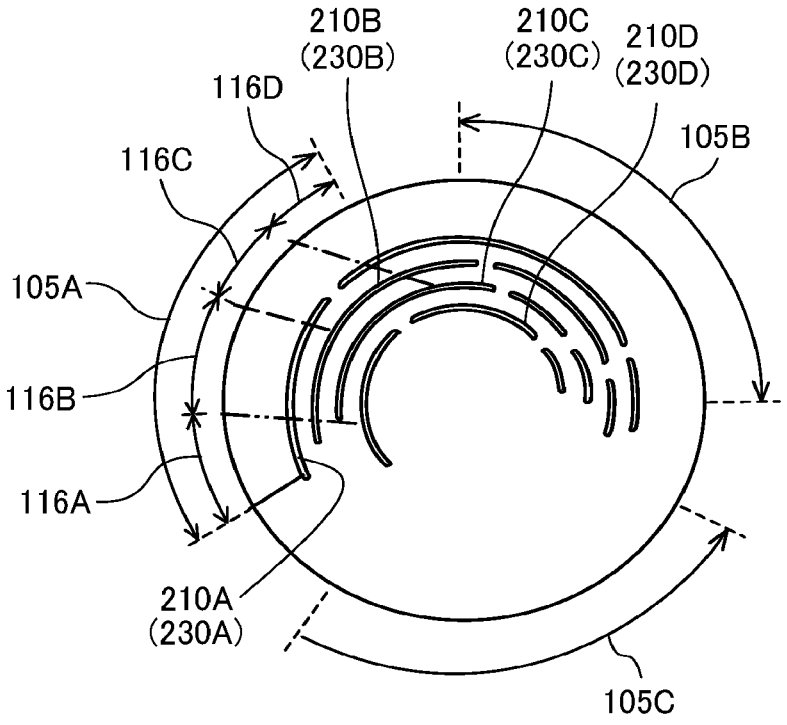
FIG. 20 is a side view of the drum illustrating an allocation of the bearing region and grooves of the fixing part.

FIG. 20 is a side view of the drum 51 illustrating the allocation of the bearing regions 105 and the through grooves 231.

As described above, the circumferential surface of the drum 51 is divided into three bearing regions 105 (105A to 105C). One bearing region 105 is divided into four regions of the first region 116A to the fourth region 116D.

Then, the outermost groove row 210A of the fixing part 201 is allocated to the first region 116A. The groove row 230A of the first member 203 switches between communication and noncommunication with each suction port 111 of the first region 116A. That is, the groove row 230A connects and disconnects each suction port 111 of the first region 116A.

Further, the groove row 210D other than the groove row 210A is allocated to the second region 116B. The groove row 230D of the first member 203 switches between communication and noncommunication with each suction port 111 of the second region 116B. That is, the groove row 230D connects and disconnects each suction port 111 of the second region 116B. Similarly, the groove row 210B of the fixing part 201 is allocated to the third region 116C.

The groove row 230B of the first member 203 switches between communication and noncommunication with each suction port 111 of the third region 116C. That is, the groove row 230B connects and disconnects each suction port 111 of the third region 116C.

Similarly, the groove row 210C of the fixing part 201 is allocated to the fourth region 116D. The groove row 230C of the first member 203 switches between communication and noncommunication with each suction port 111 of the fourth region 116D. That is, the groove row 230C connects and disconnects each suction port 111 of the fourth region 116D.

Next, a switching operation (size switching operation) of the suction regions (suction areas) by relative rotation of the first member 203 and the second member 204 is described with reference to FIGS. 21A to 21C and FIGS. 22A to 22C.

FIGS. 21A to 22C illustrate the switching operation (size switching operation) of the suction regions by the relative rotation of the first member 203 and the second member 204.

Figure 21A:
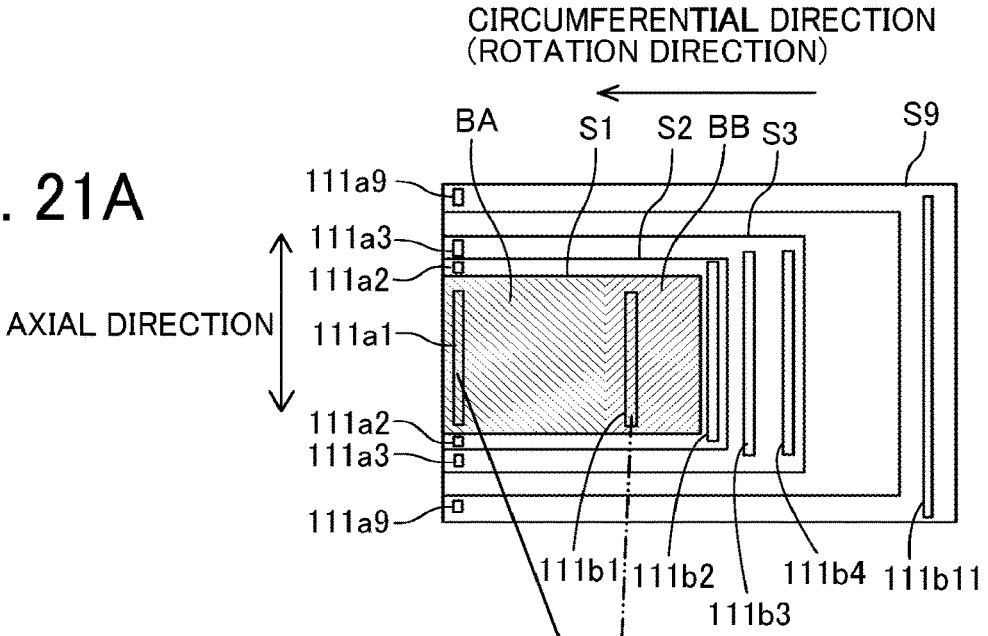
FIGS. 21A to 21C are a schematic plan view and a side view of the drum illustrating changing of suction regions (size changing) by relative rotation of the first member and the second member.
Figure 22A:
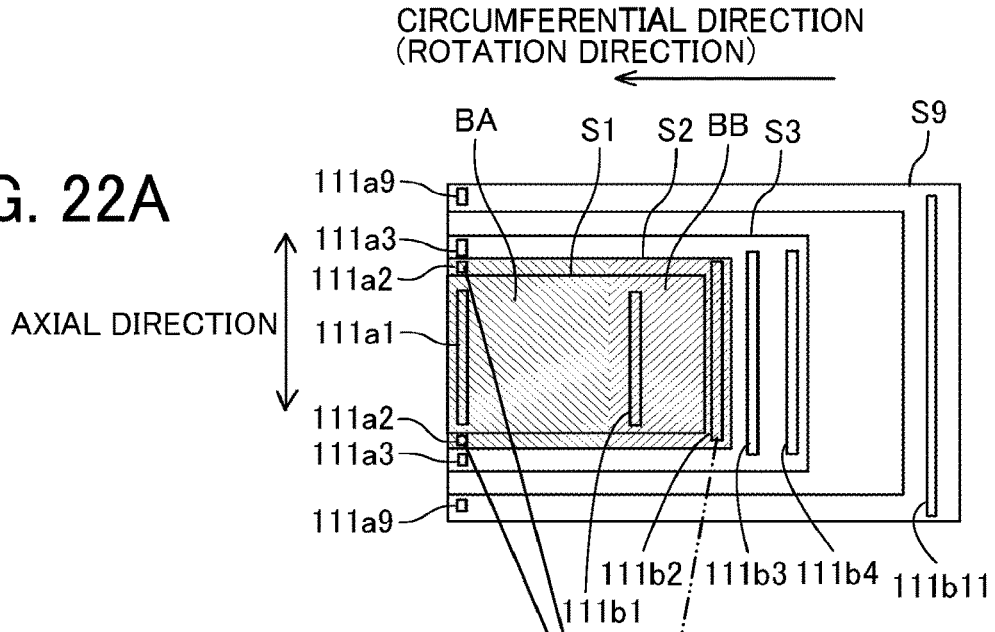
FIGS. 22A to 22C are a schematic plan view and a side view of the drum illustrating changing of suction regions (size changing)

FIGS. 21A and 22A are schematic plan views of the drum 51 illustrating the size of the sheet P and the suction ports 111 on the drum 51.

Figure 21B:
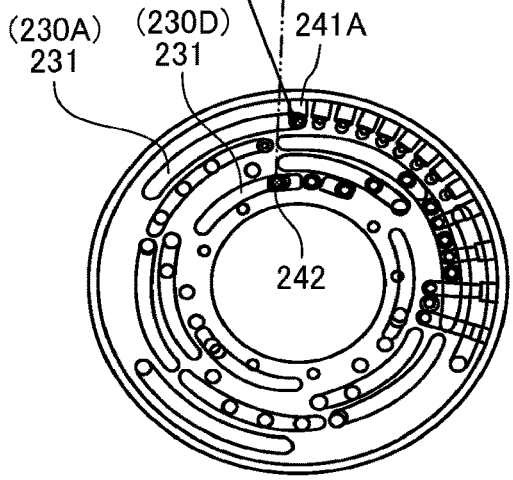
Figure 22B:
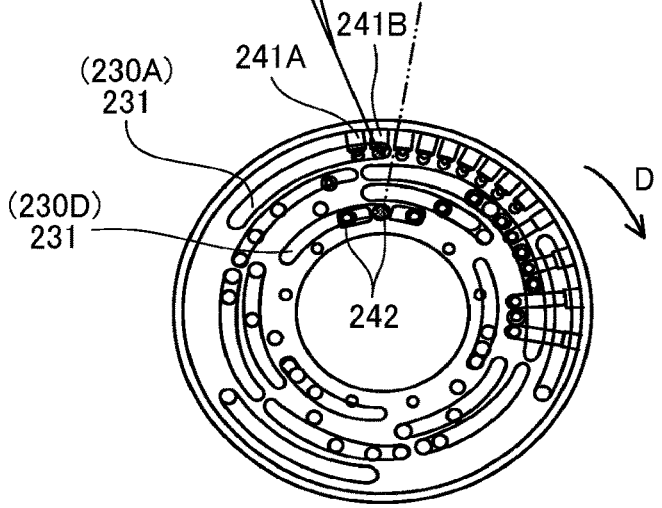

FIGS. 21B and 22B are schematic transparent side views of the first member 203 and the second member 204.

Figure 21C:
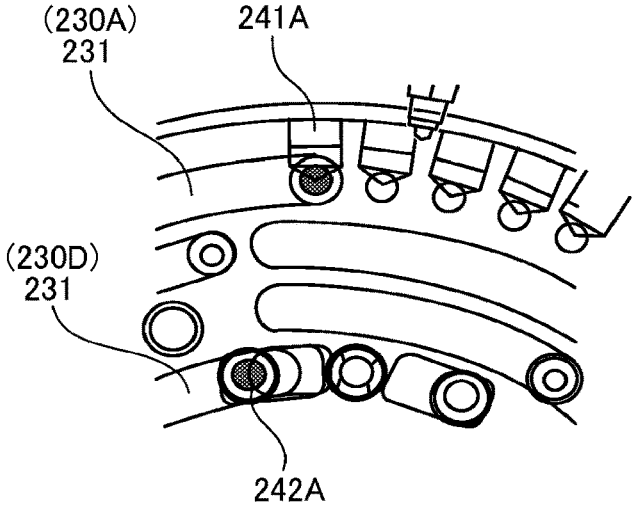
Figure 22C:
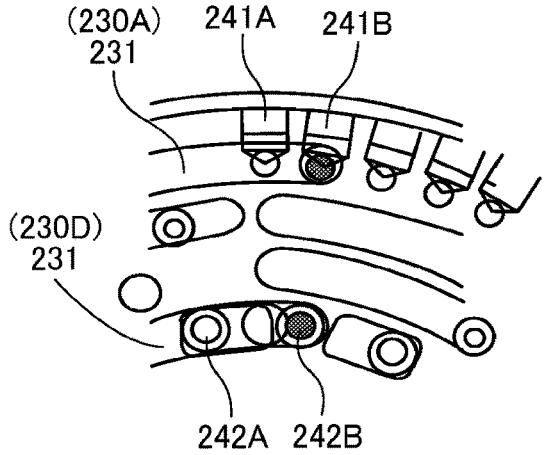

FIGS. 21C and 22C are enlarged transparent side views of the first member 203 and the second member 204 in FIGS. 21B and 22B.

As described above, the nine holes 241A to 241I in the circumferential direction of the second member 204 communicate with the nine suction ports 111*a* (111*a*1 to 111*a*9) of the drum 51.

Therefore, switching (changing) of a number of holes 241 of the second member 204 (thus a number of suction ports 111*a* of the drum 51) communicating with the through groove 231 of the groove row 230A of the first member 203 switches (changes) the size of the suction region in the axial direction of the drum 51. The axial direction is perpendicular to the circumferential direction of the drum 51 (see FIGS. 21A and 22A).

That is, switching (changing) of the number of holes 241 of the second member 204 (number of suction ports 111*a* of the drum 51) communicating with the through grooves 231 of the first member 203 switches (changes) the number of the suction holes 112 facing the chamber 113 with which the suction ports 111*a* of the drum 51 communicate.

Further, the holes 242 of the second member 204 (suction ports 111*b* (111*b*1 to 111*b*11) of the drum 51) communicate with one of the groove rows 230B to 230D of the first member 203.

Therefore, switching (changing) of a number of suction ports 111*b* (111*b*1 to 111*b*11) of the drum 51 communicating with the through groove 231 of the groove rows 230B to 230D of the first member 203 via the holes 242 of the second member 204 switches (changes) the size of the suction region in the circumferential direction of the drum 51.

That is, switching (changing) of the number of holes 242 of the second member 204 (number of suction ports 111*b* of the drum 51) communicating with the through grooves 231 of the first member 203 switches (changes) the number of the suction holes 112 facing the chamber 113 with which the suction ports 111*b* of the drum 51 communicate.

For example, as illustrated in FIGS. 21B and 21C, the relative positional relation between the first member 203 and the second member 204 is set to a state in which the through groove 231 of the groove row 230A of the first member 203 communicates with the hole 241A of the second member 204, and the through groove 231 of the groove row 230D of the first member 203 communicates with the hole 242A of the second member 204.

Thus, the suction device 52 communicates with the suction port 111*a*1 of the drum 51. Further, the suction device 52 communicates with the suction ports 111*b*1 of the drum 51.

Thus, as illustrated in FIG. 21A, the suction device 52 sucks air through the suction holes 112 belonging to a region BA communicating with the suction port 111*a*1 and a region BB communicating with the suction port 111*b*1 so that the suction device 52 sucks the air in the suction region of the sheet region S1.

From the state in FIG. 21A, the first member 203 is rotated in a direction indicated by arrow "D" in FIG. 22B so that the relative positional relation between the first member 203 and the second member 204 becomes a state in which the through groove 231 of the groove row 230A of the first member 203 communicates with the two holes 241A and 241B of the second member 204, and the through groove 231 of the groove row 230D of the first member 203 communicates with the two holes 242A and 242B of the second member 204.

Note that shaded circles in FIGS. 22B and 22C indicate the holes 241 and 242 (i.e. the hole 241B and 242B) that are new holes 241 and 242 of the second member 204 communicating with the through groove 231 of the first member 203.

Then, the suction device 52 communicates with the suction ports 111*a*1 and 111*a*2 of the drum 51. Further, the suction device 52 communicates with the suction ports 111*b*1 and 111*b*2 of the drum 51.

Thus, as illustrated in FIG. 22A, the suction device 52 sucks air through the suction holes 112 belonging to a region BA communicating with the suction port 111*a*1 and 111*a*2 and a region BB communicating with the suction port 111*b*1 and 111*b*2 so that the suction device 52 can suck the air in the suction region of the sheet region S2 having an area larger than the sheet region S1.

FIGS. 23A to 23C, FIGS. 24A to 24C, and FIGS. 25A to 25C illustrate transition of the relative positions between the first member 203 and the second member 204 when the first member 203 is rotated to change the relative positions in nine rotation steps (nine rotation phases) in the above-described configuration of the rotary valve 200.

FIGS. 23A to 23C, FIGS. 24A to 24C, and FIGS. 25A to 25C are schematic transparent side views of the first member 203 and the second member 204.

Figure 23C:
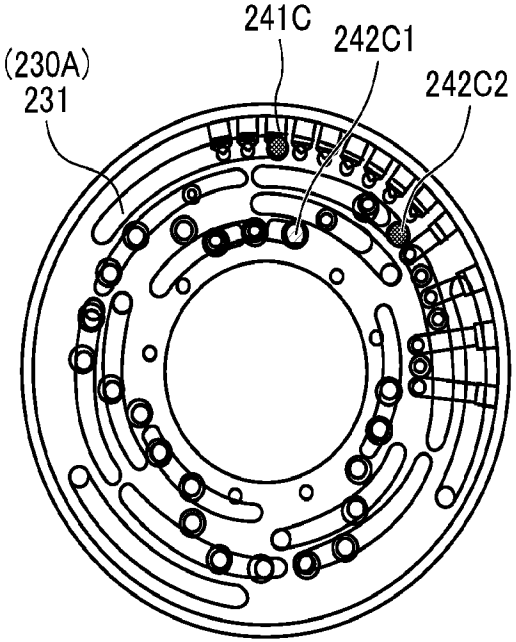
FIGS. 23A to 23C are schematic transparent side views of the first member and the second member in a transition state of a relative positions between the first member and the second member when the relative positions are changed in nine steps.
Figure 23B:
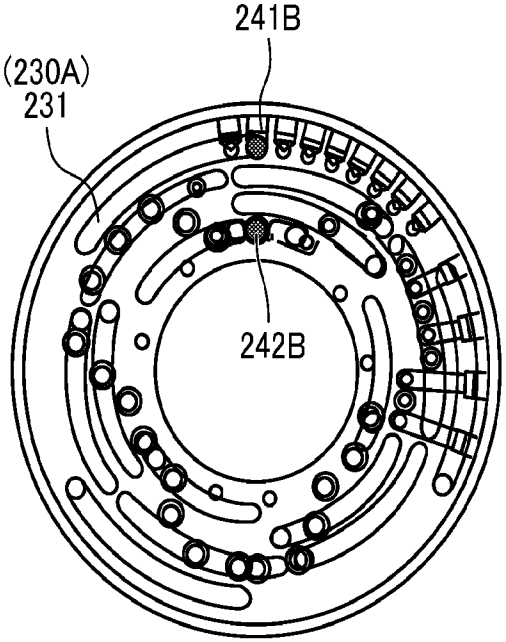
Figure 23A:
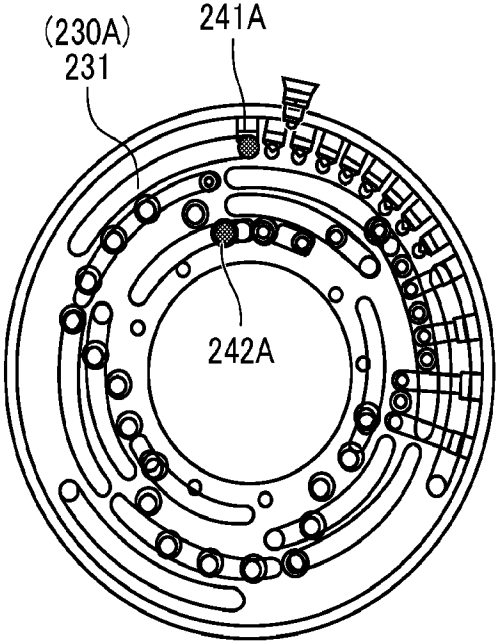
Figure 24A:
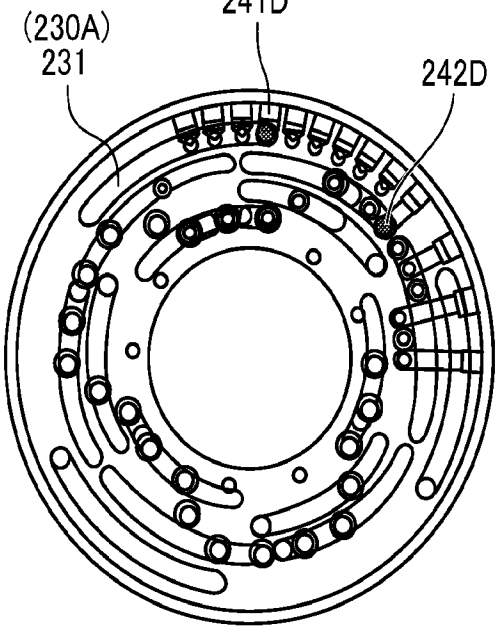
FIGS. 24A to 24C are schematic transparent side views of the first member and the second member illustrating the transition state following the transition state in FIG. 23A to 23C.
Figure 24B:
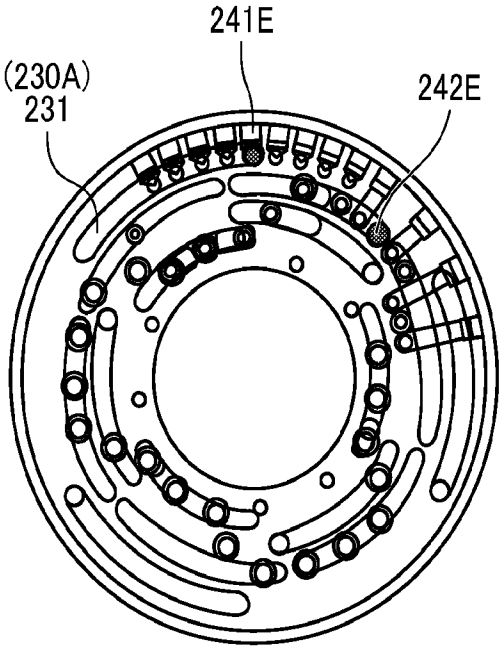
Figure 24C:
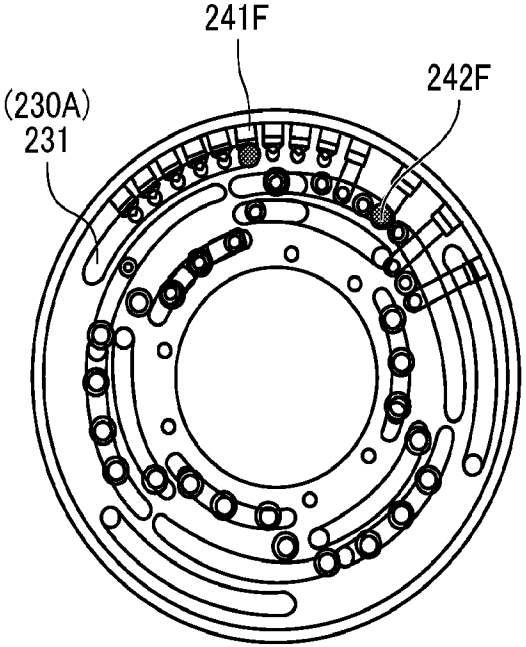
Figure 25A:
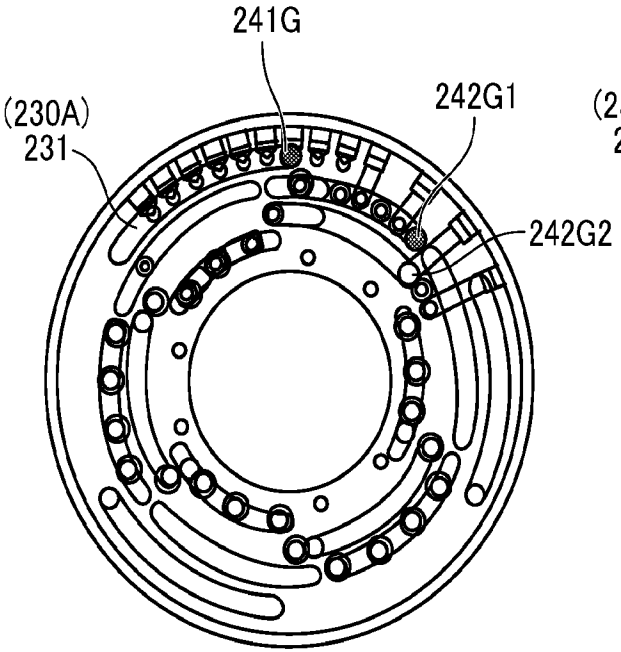
FIGS. 25A to 25C are schematic transparent side views of the first member and the second member illustrating the transition state following the transition state in FIG. 24A to 24C.
Figure 25B:
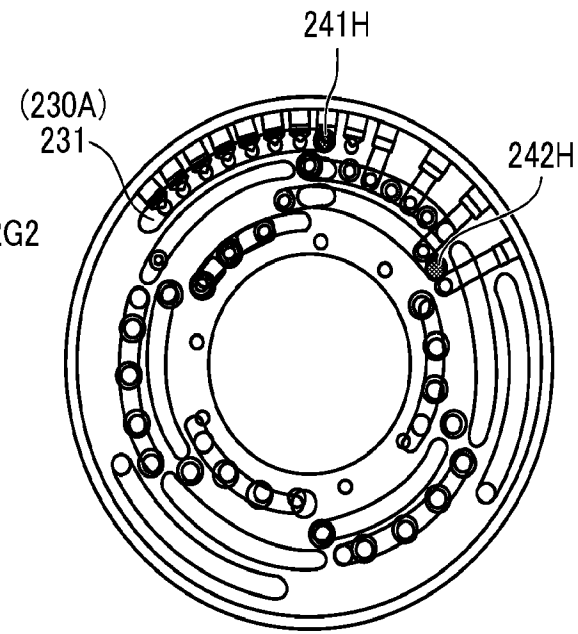
Figure 25C:
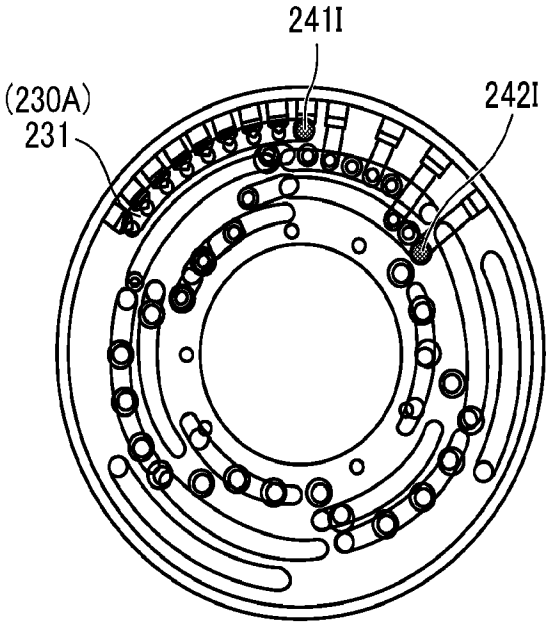

Note that the relative position of FIG. 23A is the same with the relative position of FIG. 21B. Further, the relative position of FIG. 23B is the same with the relative position of FIG. 22B.

The holes 241 and 242 of the second member 204 are arranged so that the two or three holes 241 and 242 communicate with one of the bearing regions 105 of the drum 51 each time the relative position is switched (changed) by one rotation step (one rotation phase).

The rotary valve 200 according to the first embodiment includes the drum 51 having three bearing regions 105 (105A to 105C, see FIG. 4). Thus, a number of the holes 241 and 242 of the second member 204 communicate with the bearing regions 105 by one rotation step (one rotation phase) of the first member 203 becomes six or nine.

The number of holes 241 and 242 are set to two or three for one rotation step (one rotation phase) so that the sheet suction device 50 can select the suction regions according to the destination of the sheet P. For example, three suction ports 111*b* of the drum 51 may be allocated to an innermost groove row 230D of the first member 203 via the holes 242 of the second member 204, and five suction ports 111*b* of the drum 51 may be allocated to the groove row 230C of the first member 203 via the holes 242 of the second member 204.

Further, two suction ports 111*b* of the drum 51 may be allocated to the innermost groove row 230D of the first member 203 via the holes 242 of the second member 204, and five suction ports 111*b* of the drum 51 may be allocated to the groove row 230C of the first member 203 via the holes 242 of the second member 204.

Next, the relationship between the rotation direction of the first member 203 and an expansion direction of the suction region (suction area) in the drum 51 is described with reference to FIG. 26.

Figure 26:
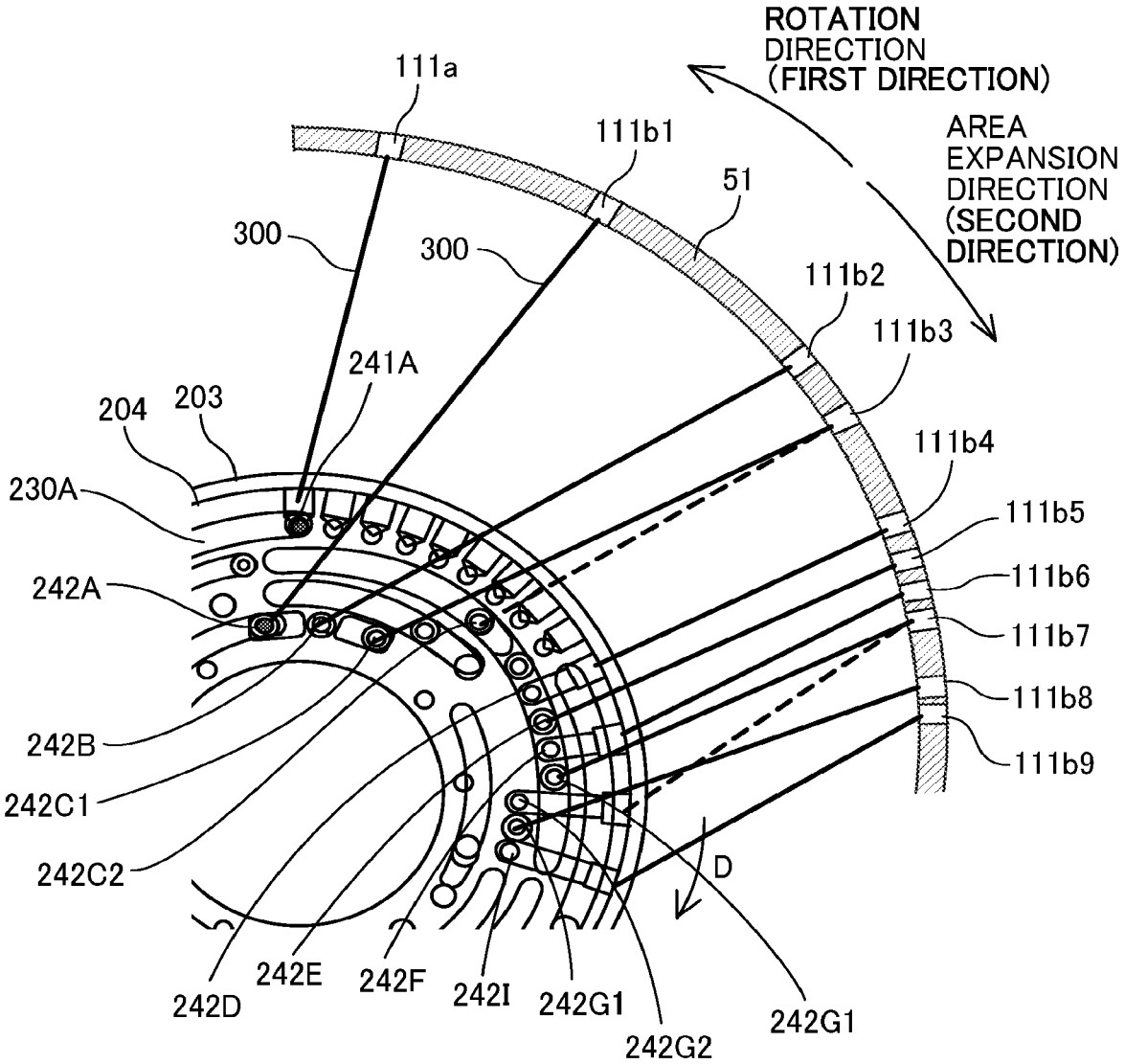
FIG. 26 is an enlarged side view of the drum illustrating a relation between a rotation direction of the first member and an expansion direction of the suction region of the drum.

FIG. 26 is a schematic side view of the drum 51 and the rotary valve 200 illustrating the relation between the rotation direction of the first member 203 and the expansion direction of the suction region (suction area) of the drum 51.

The holes 241 (241A to 241I) of the second member 204 are connected to the suction ports 111*a* (111*a*1 to 111*a*9) of the drum 51 by the suction channels 300. The holes 242 (242A to 242I) of the second member 204 are similarly connected to the suction ports 111*b* (111*b*1 to 111*b*9) of the drum 51 by the suction channels 300. The suction port 111*a* of the drum 51 is disposed on the most downstream in the rotation direction (first direction) of the drum 51. The rotation direction is also referred to as a "sheet conveyance direction". The suction ports 111*b*1 to 111*b*9 are sequentially arrange toward the upstream in the rotation direction (area expansion direction) of the drum 51.

The first member 203 is rotated in the area expansion direction indicated by arrow "D" in FIG. 26 relative to the second member 204 so that a number of connections between through groove 231 of the groove row 230A of the first member 203 and the openings 241*a* (see FIG. 14A) of the holes 241A to 241I (see FIG. 15) of the second member 204 monotonously increases.

The area expansion direction is a clockwise direction in FIG. 26 and is also referred to as a "predetermined direction". Further, the first member 203 is rotated in the area expansion direction indicated by arrow D so that the holes 242A to 242I of the second member 204 are sequentially connected to the suction ports 111*b*1 to 111*b*9 of the drum 51.

Thus, the suction region (suction area) sequentially expands in the area expansion direction (clockwise direction in FIG. 26) like the sheet regions S1 to S9 as illustrated in FIG. 6.

Then, the rotation direction (indicated by arrow "D") of the first member 203 becomes the same as an area expansion direction of the suction region (suction area) in the drum 51. The area expansion direction is indicated by arrow "area expansion direction" in FIG. 26 and is the second direction opposite to the rotation direction of the drum 51 (first direction).

That is, rotation of the first member 203 in the predetermined direction (area expansion direction) can expand the suction region (suction area) of the drum 51 in the predetermined direction (area expansion direction).

Conversely, an operator who operates the first member 203 to switch (change) the size of the sheet P usually recognizes that a direction to expand the size of the sheet P is in a backward direction (upstream direction) in the rotation direction (a direction opposite to the rotation direction of the drum 51), that is, the area expansion direction in FIG. 26. The rotation direction is the same as the sheet conveyance direction (first direction).

Thus, the rotation direction of the first member 203 of the rotary valve 200 is configured to be the same as the area expansion direction (clockwise direction in FIG. 26) of the suction region of the drum 51 so that the user can intuitively operate the rotary valve 200. The rotation direction of the first member 203 of the rotary valve 200 is a second direction opposite to the rotation direction of the drum 51, that is, the first direction in the sheet conveyance direction to convey the sheet P.

Thus, the second direction in which the first member 203 rotates to expands the suction region is opposite to the first direction in which the drum 51 rotates to convey the sheet P.

The rotary valve 200 according to a second embodiment of the present disclosure is described with reference to FIGS. 27 and 28.

Figure 27:
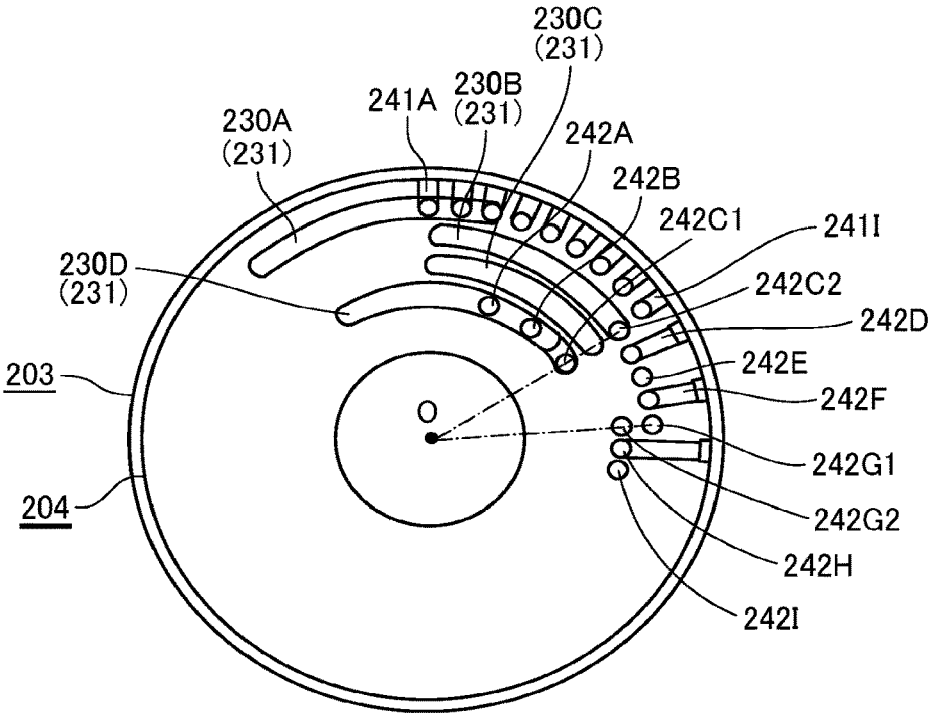
FIG. 27 is a schematic side view of the first member and the second member overlaid on the first member of the rotary valve according to the second embodiment.

FIG. 27 is a schematic side view of the first member 203 and the second member 204 overlaid on the first member 203 of the rotary valve 200 according to the second embodiment.

Figure 28:
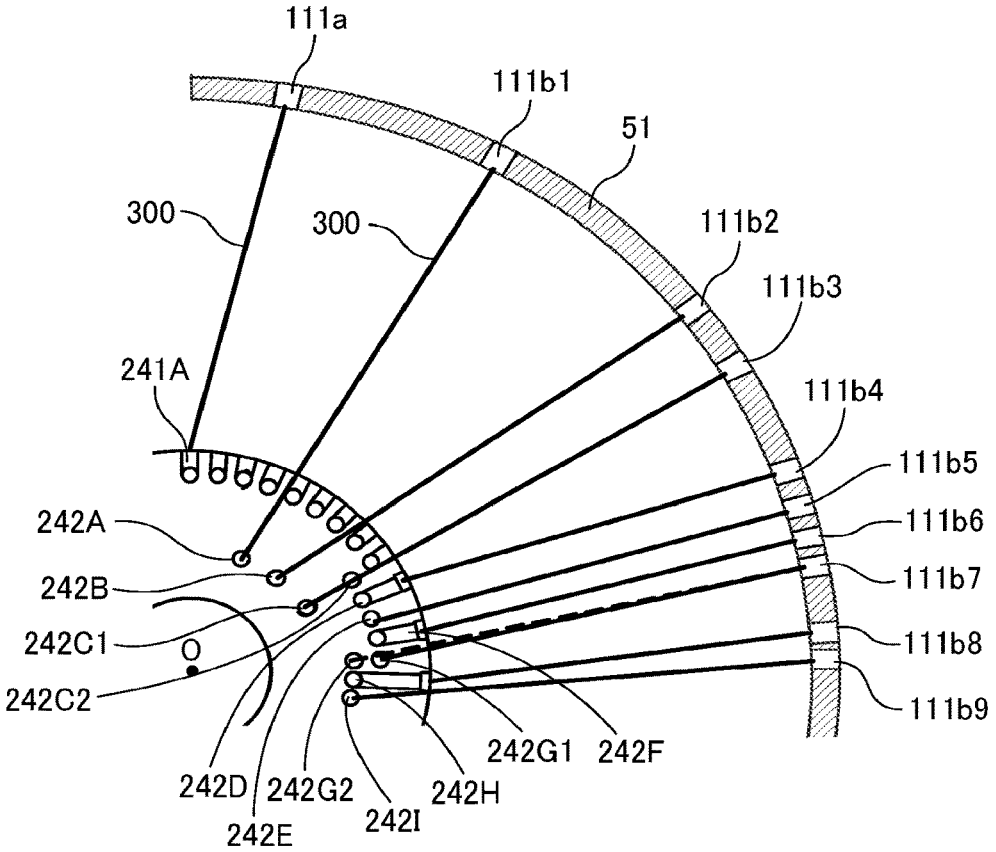
FIG. 28 is a schematic enlarged side view of the drum and the rotary valve illustrating a connection relation between the rotary valve and suction holes of the drum.

FIG. 28 is a schematic enlarged side view of the drum 51 and the rotary valve 200 illustrating a connection relation between the rotary valve 200 and the suction holes 112 of the drum 51.

The second member 204 of the rotary valve 200 according to the second embodiment includes the holes 242C1 and 242C2 that are linearly arranged in a row in the radial direction with respect to the rotation center O of the second member 204. The holes 242C1 and 242C2 of the second member 204 are selected according to the destination as in the first embodiment. Similarly, the holes 242G1 and 242G2 are also linearly arranged in a row in the radial direction with respect to the rotation center O of the second member 204.

Thus, a distance between the holes 242C1 and 242C2 in the second embodiment (see FIG. 27) becomes shorter than a distance between the holes 242C1 and 242C2 in the first embodiment (see FIG. 15). Further, a distance between a distance between the holes 242G1 and 242G2 in the second embodiment (see FIG. 27) becomes shorter than a distance between the holes 242G1 and 242G2 in the first embodiment (see FIG. 15).

Thus, the distance between the holes 242C1 and 242C2 or the distance between the holes 242G1 and 242G2 becomes the shortest when the holes 242C1 and 242C2 or the holes 242G1 and 242G2 are arranged on a straight line in the radial direction.

Such a configuration in FIG. 27 can improve a workability of changing the holes 242 because the distance between the two holes 242C1 and 242C2 or the two holes 242G1 and 242G2 becomes short. The two holes 242C1 and 242C2 or the two holes 242G1 and 242G2 are selectively used.

That is, the holes 242 of the second member 204 are respectively connected with the hoses (tubes) via connectors so that connectors and hoses (tubes) are densely packed. The hoses 56 (tubes) are connected to the holes 242 to be used via the connectors among the holes 242 selectable according to the destination. Conversely, plugs are plugged into the holes 242 not to be used to maintain airtightness.

After a shipment of the printer 1, the destination may be changed by a usage change (reuse). Further, and the through groove 231 to be used may be changed to customize the suction plate 102 on a surface of the drum 51 (see FIG. 4) after the shipment of the printer 1.

In such a case, the rotary valve 200 according to the second embodiment can improve the workability of changing the holes 242 to be used since the connector to be replaced and the plug are arranged adjacent to each other. Such a configuration of the rotary valve 200 can reduce a number of parts to be replaced and a time needed to replace and confirm the parts are reduced when changes are made to the printer 1.

The rotary valve 200 according to the second embodiment configures both the holes 242G1 and 242G2 by through holes. Thus, the holes 242G1 and 242G2 are arranged parallel in the axial direction of the second member 204. The holes 242G1 and 242G2 are simultaneously and respectively communicating with the suction ports 111 of the drum 51. Thus, the directions of the hoses 56 (tubes) and the connectors to connected to the holes 242G1 and 242G2 of the second member 204 become the same that facilitates a changing of connections of hoses 56 (tubes).

The holes 241 (241A to 241I) of the second member 204 are connected to the suction ports 111*a* (111*a*1 to 111*a*9) of the drum 51 by the suction channels 300 as illustrated in FIG. 28. The holes 242 (242A to 242I) of the second member 204 are similarly connected to the suction ports 111*b* (111*b*1 to 111*b*9) of the drum 51 by the suction channels 300.

As illustrated in FIG. 28, the suction channels 300 do not intersect with each other when the rotary valve 200 is viewed from the axial direction of the drum 51, that is, from a front of the sheet of FIG. 28. The suction channels 300 connect the holes 241 and 242 of the second member 204 and the suction ports 111*a*, 111*b*1 to 111*b*9 of the drum 51.

That is, the suction channels 300 do not intersect with each other when the drum 51 and the rotary valve 200 are viewed from the axial direction of the drum 51. The suction channels 300 connect the plurality of holes 242 of the second member 204 and the plurality of suction ports 111 of the drum 51.

Thus, the rotary valve 200 can prevent the user to mistakenly connect the hoses 56 (tubes) or the like that configure the suction channel 300 to the holes 242 of the second member 204 during performing maintenance.

When the hole 242G2 is used in the rotary valve 200 according to the first embodiment as illustrated in FIG. 26, the suction channel 300 that connects the hole 242G2 and the suction port 111*b*7 indicated by a broken line intersects with the suction channel 300 that connects the hole 242H and the suction port 111*b*8.

Next, a switching operation of the first member 203 is described with reference to FIGS. 29 to 32.

Figure 29:
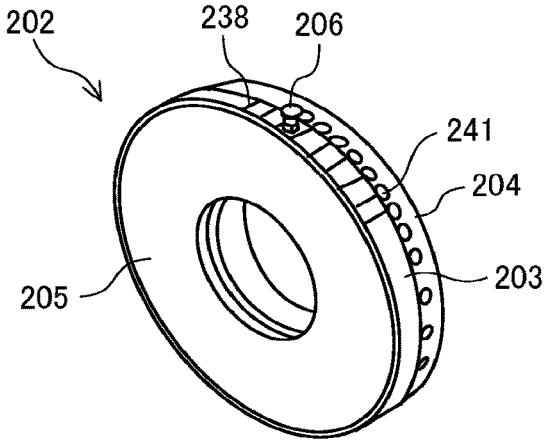
FIG. 29 is a schematic perspective view of a rotating part of the rotary valve illustrating a changing operation of the first member.

FIG. 29 is a schematic perspective view of the rotation part 202 of the rotary valve 200.

Figure 30:
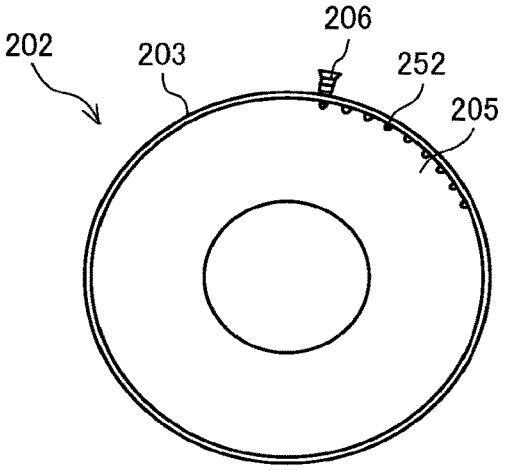
FIG. 30 is a schematic side view of the rotating part of the rotary valve.

FIG. 30 is a schematic side view of the rotary valve 200 of FIG. 29.

Figure 31:
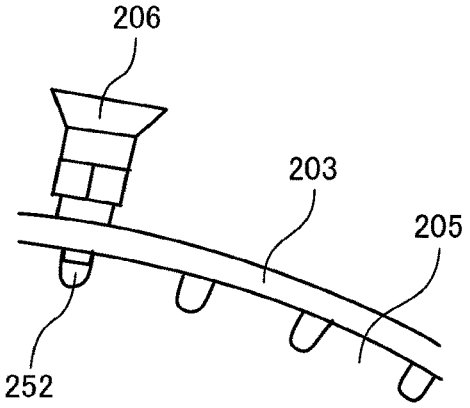
FIG. 31 is an enlarged side view of a part of the rotating part.

FIG. 31 is an enlarged schematic side view of the rotation part 202 of the rotary valve 200.

Figure 32:
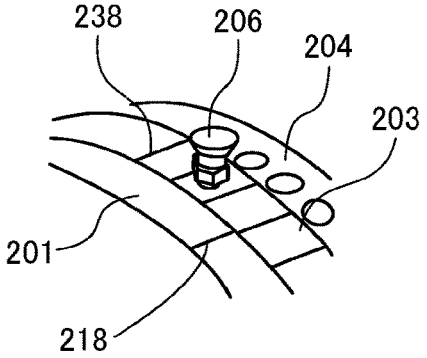
FIG. 32 is an enlarged perspective view of a main part of the rotating part.

FIG. 32 is an enlarged schematic perspective view of a main part of the rotary valve 200.

The first member 203 of the rotary valve 200 according to the second embodiment is manually rotatable by the user. Thus, the first member 203 is manually rotated by the user to switch (change) the suction regions. An index plunger 206 is used to rotate the first member 203.

A rotation operation of the first member 203 is also referred to as a "suction region changing (switching) operation."

A leading end of the index plunger 206 is fitted into holes 252 formed on a circumferential surface of the third member 205 according to each position of the suction regions to determine the position of the suction region.

To rotate the first member 203, the user pulls out the index plunger 206 from the hole 252 and rotates the first member 203 relative to the second member 204 and the third member 205 to a target position. Then, the user inserts the leading end of the index plunger 206 into the hole 252 at the target position.

A scale 238 having nine steps, for example, is formed on the circumferential surface of the first member 203 to indicate a rotation position of the first member 203 so that the user can recognize a setting state of the first member 203. Thus, the scale 238 serves as an "indicator" to indicate the rotation position of the first member 203.

Further, as illustrated in FIG. 32, a scale 218 as a reference for the scale 238 of the first member 203 may be formed on a circumferential surface of the fixing part 201.

Further, the drum 51 is fixed at a predetermined phase (predetermined position) to change the suction region such as a "sheet size changing mode", for example, so that the user can access the index plunger 206. Further, the drum 51 is fixed at the predetermined phase (predetermined position) so that the drum 51 is not rotated by an operational force of the user operating the index plunger 206.

Next, acquisition of size information of the suction region (suction area) is described with reference to FIG. 33.

Figure 33:
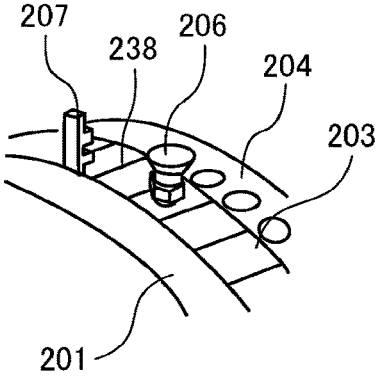
FIG. 33 is an enlarged perspective view of a main part of the rotary valve illustrating acquisition of size information in the suction region.

FIG. 33 is a schematic enlarged partial perspective view pf the rotary valve 200 illustrating the acquisition of the size information of the suction region.

Here, a photosensor 207 is attached to the fixing part 201 that does not rotate together with the drum 51. The first member 203 includes a detection piece (feeler) detectable by the photosensor 207. Such a configuration of the rotary valve 200 including the photosensor 207 can detect the detection piece (feeler) by the photosensor 207 for each one rotation of the drum 51 with a rotation of the first member 203 rotating together with the drum 51. The photosensor 207 serves as a detector to detect the feeler and generates one pulse for each one rotation of the drum 51.

The drum 51 may include a similar mechanism of the photosensor 207 and the feeler. Thus, the rotary valve 200 can detect one pulse from the feeler on the drum 51 and detect another one pulse from the feeler on the first member 203 during one rotation of the drum 51 so that the rotary valve 200 can obtain a total of two pulses during one rotation of the drum 51.

The first member 203 has a phase difference with the second member 204 that rotates together with the drum 51. Thus, intervals between the pulses generated from each of the drum 51 rotating at a constant speed and the first member 203 are measured to detect a rotation angle of the first member 203. Thus, the relative phase difference, that is, the setting information of the suction region can be acquired.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet suction device comprising:

a drum configured to bear a sheet on a circumferential surface of the drum and rotate in a first direction;

a plurality of suction holes in a bearing region in the circumferential surface of the drum;

a suction device connected to the plurality of suction holes, the suction device configured to suck the sheet through the plurality of suction holes;

a first member between the plurality of suction holes and the suction device, the first member rotatable in a second direction different from the first direction to change a suction region of the suction device connected to the plurality of suction holes, and a detector to detect a rotation angle of the first member, wherein a rotation of the first member in the second direction expands the suction region of the suction device in the bearing region of the drum.

2. The sheet suction device according to claim 1, wherein:

the drum is to rotate in the first direction to convey the sheet, and the second direction is opposite to the first direction.

3. The sheet suction device according to claim 1, wherein the rotation of the first member in the second direction increases a number of the plurality of suction holes connected to the suction device.

4. The sheet suction device according to claim 1,
wherein the drum is bearable a plurality of sheets on the circumferential surface in a circumferential direction of the drum.

5. The sheet suction device according to claim 1, further comprising:
a second member including a plurality of holes on a side surface in a circumferential direction of the second member; and
a plurality of suction channels respectively connects the plurality of holes of the second member and the plurality of suction holes,
wherein the first member includes grooves connected to the suction device, the grooves on a side surface of the first member in a circumferential direction of the first member,
the rotation of the first member relative to the second member changes a number of the plurality of holes of the second member connected to the grooves of the first member and changes a number of the plurality of suction holes connected to the suction device, and
the plurality of suction channels does not intersect with each other.

6. The sheet suction device according to claim 5,
wherein the first member and the second member rotate together with the drum.

7. The sheet suction device according to claim 6,
wherein the second member rotates together with the drum.

8. The sheet suction device according to claim 1,
wherein the first member is manually rotatable.

9. The sheet suction device according to claim 1,
wherein the drum includes a plurality of suction ports on the bearing region in a circumferential direction of the drum, and
the rotation of the first member changes a number of the plurality of suction ports connected to the suction device in the circumferential direction of the drum.

10. The sheet suction device according to claim 1,
wherein the drum includes a plurality of suction ports on the bearing region in an axial direction of the drum, and
the rotation of the first member changes a number of the plurality of suction ports connected to the suction device in the axial direction of the drum.

11. The sheet suction device according to claim 1, further comprising a conveyer,
wherein the drum is configured to rotate and convey the sheet in the first direction.

12. The sheet suction device according to claim 11, further comprising:
a printer comprising:
a liquid discharge device configured to discharge a liquid onto the sheet.

13. A suction region changing device between a plurality of suction holes and a suction device, the suction region changing device comprising:
a first member between the plurality of suction holes and the suction device, the first member configured to rotate and change a suction region of the suction device connected to the plurality of suction holes to suck a sheet;
a second member including a plurality of holes on a side surface in a circumferential direction of the second member; and
a detector to detect a rotation angle of the first member,
wherein the first member includes grooves connected to the suction device, the grooves on a side surface in a circumferential direction of the first member, and
a rotation of the first member in one direction relative to the second member increases a number of the plurality of holes of the second member connected to the grooves of the first member and increases a number of the plurality of suction holes connected to the suction device.

14. The sheet suction device according to claim 1, further comprising a scale formed on a circumferential surface of the first member that indicates a rotation position of the first member.

* * * * *